US007580815B2

(12) United States Patent
Kawakami et al.

(10) Patent No.: US 7,580,815 B2
(45) Date of Patent: Aug. 25, 2009

(54) INFORMATION PROCESSING APPARATUS AND ITS CONTROL METHOD

(75) Inventors: Tatsuro Kawakami, Yokohama (JP); Kenji Taki, Kawasaki (JP); Takao Kikutani, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 715 days.

(21) Appl. No.: 11/248,883

(22) Filed: Oct. 12, 2005

(65) Prior Publication Data

US 2006/0077246 A1 Apr. 13, 2006

(30) Foreign Application Priority Data

Oct. 13, 2004 (JP) ..... 2004-298888
Dec. 14, 2004 (JP) ..... 2004-361487
Sep. 16, 2005 (JP) ..... 2005-270411

(51) Int. Cl.
*G06F 17/50* (2006.01)
*G03G 15/16* (2006.01)

(52) U.S. Cl. ..... 703/2; 703/6; 703/7; 399/111; 399/302; 700/86

(58) Field of Classification Search ..... 703/2, 703/6, 7; 399/111, 302; 700/86
See application file for complete search history.

(56) References Cited

U.S. PATENT DOCUMENTS 4,877,234 A * 10/1989 Mandel ..... 271/225
5,831,853 A * 11/1998 Bobrow et al. ..... 700/86
7,194,224 B2 * 3/2007 Niimi et al. ..... 399/111
2002/0114650 A1 * 8/2002 May et al. ..... 399/302
2004/0167759 A1 8/2004 Kawakami
2006/0074613 A1 * 4/2006 Oyama ..... 703/2

FOREIGN PATENT DOCUMENTS

JP 11-116113 A 4/1999
JP 11-195052 A 7/1999
JP 2000-222454 A 8/2000
JP 2003-242197 A 8/2003
JP 2004-189436 A 7/2004
JP 2004-258774 A 9/2004

OTHER PUBLICATIONS

Korean Notice of Allowance dated May 21, 2007, issued in the corresponding Korean Patent Application No. 9-5-2007-027369662.
Korean Office Action dated Nov. 24, 2006, concerning the corresponding Korean Patent Application.

* cited by examiner

*Primary Examiner*—Thai Phan
(74) *Attorney, Agent, or Firm*—Rossi, Kimms & McDowell, LLP

(57) ABSTRACT

When the convey behavior of a flexible medium conveyed in a conveying path is analyzed by simulation, a design support apparatus of this invention executes 1) processing for approximating a nip on a model to an actual nip, 2) processing for matching a feature point of a drive chart with a calculation step upon making a numerical calculation for solving a motion of a flexible medium using the drive chart, and 3) processing for reflecting velocity variations due to deformation of a convey roller pair, thus implementing a simulation with high accuracy. When the design support apparatus of this invention is used, even a designer who does not have expert knowledge on simulation can analyze the convey behavior of the flexible medium conveyed in the conveying path with relatively higher accuracy.

20 Claims, 26 Drawing Sheets

FIG. 21

VELOCITY VARIATION RATE CALCULATION

| | | |
|---|---|---|
| DRIVING ROLLER DIAMETER | 60 | mm |
| DRIVEN ROLLER DIAMETER | 60 | mm |
| PRESSURE | 100 | kg |
| RUBBER THICKNESS | 3 | mm |
| SURFACE LAYER THICKNESS | 30 | μm |
| RUBBER YOUNG'S MODULUS | 1.5 | Mpa |

VELOCITY VARIATION RATE 1.038 OK

703

INFORMATION PROCESSING APPARATUS AND ITS CONTROL METHOD

FIELD OF THE INVENTION

The present invention relates to an information processing apparatus such as a design support apparatus that can be used in design support or the like, its control method, a computer-executable program that implements the method, and a storage medium which computer-readably stores the program. More particularly, the present invention relates to a technique for making optimal design of a conveying path by analyzing the behavior of a printing medium conveyed in a conveying path by computer simulation in an image forming apparatus such as a copying machine, printer, or the like.

BACKGROUND OF THE INVENTION

In a design process of a conveying path, examination of functions of a product to be designed under various conditions before production of an actual product can reduce the number of steps required to manufacture and test a prototype, and can reduce the development period and cost. In order to simulate the behavior of a paper sheet in a conveying path for such purpose, an equation of motion that describes the motion of a flexible, sheet-like printing medium (to be referred to as a flexible medium hereinafter) such as a paper sheet, film, or the like, which is conveyed in a conveying path of a copying machine, printer, or the like must be solved. Note that the printer includes an LBP (laser beam printer), ink-jet printer, and the like. In order to solve this equation of motion, a space and time must be algebraically approximated as finite quantities, and their simultaneous equations must be solved. In order to algebraically approximate a space, a finite element method, difference method, and the like are known (for example, see Japanese Patent Laid-Open Nos. 11-195052 and 11-116113).

In order to solve the motion of a flexible medium, as described above, the equation of motion of the flexible medium which is discretely expressed by finite elements or mass-spring system is formulated first. Next, an analysis target time period is divided into time steps each having a finite width, and the motion of the flexible medium is solved by numerical time integration that sequentially calculates the acceleration, velocity, and deviation as unknown quantities for each time step from time 0. As the method of solving the motion of a flexible medium, the Newmark β method, Wilson θ method, Euler's method, Kutta-merson method, and the like are well known. In order to precisely simulate the convey state of a medium, element divisions of the medium and time step intervals must be set very finely. Also, a problem of, e.g., a false slip caused between the roller and medium when an unexpected external force acts during conveyance of the flexible medium must be solved. In order to solve these problems, the peripheral velocity, roller radius, and center distance of a convey roller pair are input, and the convey roller surface is divided into a pressure contact area and non-pressure contact area on the basis of the input information. Next, when a flexible medium reaches the non-pressure contact area of the convey roller pair, a convey force is applied to the flexible medium in accordance with the difference between the peripheral velocity of the non-pressure contact area and the moving velocity of the flexible medium. Also, as is well known, when the flexible medium reaches the pressure contact area of the convey roller pair, it is designed to forcibly convey the flexible medium at the peripheral velocity of the roller pair (e.g., see Japanese Patent Laid-Open No. 2004-189436).

In the aforementioned design support apparatus, when the behavior of a flexible medium in the conveying path, i.e., the convey process of the flexible medium, guide resistance, and the like, are to be accurately evaluated, the contact state of the flexible medium and convey rollers and, more particularly, a nip shape and the angles of the flexible medium at the entry and exit sides of the nip, must be accurately expressed. In the following description, the nip will be defined as a contact area of the convey roller pair.

For example, in the convey roller pair generally used in the conveying path, one convey roller uses a roller prepared by winding a flexible material with a high coefficient of friction such as rubber or the like around a core member with a high rigidity such as iron, aluminum, or the like. When this roller with the flexible surface is used, the other roller uses a roller made up of a material with a high rigidity such as iron, aluminum, or the like, and a combination of the flexible and rigid rollers are often used. Even when both the convey rollers are rubber rollers, they may have different degrees of hardness or thicknesses of rubber. For this reason, when these convey roller pair contact each other, the nip has a shape which is compressed from the high rigidity side toward the low rigidity side in place of a flat shape, and the flexible medium clamped there follows this shape. Furthermore, the angles of the flexible medium at the entrance and exit of the nip are inclined toward the rigid roller side due to the nip shape. In order to correctly calculate the behavior of a paper sheet such as the contact position, contact angle, and the like between the paper sheet and guides upon conveyance, these factors around the nip must be taken into consideration.

However, in the aforementioned design support apparatus, the nip shape formed by a contact between the flexible medium expressed as a manifold of the masses and springs and convey roller pairs does not consider any deformation difference due to the rigidity difference of the convey rollers in the convey roller pair. For this reason, as the nip shape, a method of defining a line segment that connects intersections of the convey rollers as the nip is adopted. Also, a method of defining the entry and exit angles of the flexible medium with respect to the nip in the same direction as this line segment or designating them as vectors or the like by the user is adopted. For this reason, the conventional design support apparatus which does not consider any nip shape or the like formed by a contact between the flexible medium and convey roller pair cannot often accurately evaluate an actual behavior (convey process) of the flexible medium.

On the other hand, in the aforementioned design support apparatus, it is a common practice to input the control of the convey rollers as a chart that represents the drive conditions. This chart uses values which are theoretically estimated from control conditions given by design, motor performance, and the like, values obtained by actually measuring the motions of the convey rollers, or the like.

However, in numerical calculations required to solve the motion of the flexible medium, calculations are implemented by mechanically dividing an analysis target time period into time steps each having a finite width. At this time, calculation steps do not always match feature points in the drive chart such as drive start and end times of the convey rollers, drive velocity change times, and the like. In the following description, the drive start and end times of the convey rollers or the drive velocity change times in the drive chart will be referred to as feature points. As a result, upon adjustment of calculation conditions for respective steps, the drive conditions such as the drive start and end times and the like may become different from values designated by the drive chart. Of the drive conditions of an actual device, driving may be invoked depending on a given condition during the operation such as the position of the flexible medium or the like. In this case as well, the feature points of the chart may not match the actual calculation step times.

In such case, if a person who uses this design support apparatus is the designer of this apparatus or the one who recognizes details of calculation steps, he or she can take appropriate action by evaluating whether or not the analysis result is affected by them. This is because the designer or the like recognizes problems and points to keep in mind of a numerical simulation when the calculation steps do not match the feature points in the drive chart. However, when the person who uses this design support apparatus is a general user, he or she can hardly evaluate whether or not the calculation result is affected by the aforementioned problems, and cannot determine appropriate time discretization.

As is also known, in order to accurately evaluate the behavior of the flexible medium in the conveying path by the aforementioned design support apparatus, a variation rate of the convey velocity with reference to a nominal value is calculated using the contact structure analysis scheme using a finite element model. The variation rate of the convey velocity with reference to the nominal value is produced when an elastic member 1002 such as rubber or the like which forms a roller 1001 deforms under pressure. With this method, the roller 1101 is pressed by a rigid roller 1003 by compression, and the surface of the roller 1001 deforms along the surface shape of the rigid roller 1003, as shown in FIG. 15. Note that the rollers 1001 and 1003 form a convey roller pair. The roller 1003 is a rigid roller formed of a high-rigidity material such as iron or the like, and the roller 1001 is a roller on a core surface of which a layer 1002 of a flexible material such as rubber or the like is formed. A flexible medium 1004 such as a paper sheet or the like is clamped and conveyed between the roller 1001 and rigid roller 1003. A portion where the two rollers contact the paper sheet and receive a pressure is a nip 1011. The flexible medium is conveyed while being in tight contact with the nip between the rollers. When the roller rotates by $\Delta\phi$, as shown in FIG. 16, a moving amount of the circumference of the roller 1001 at a position which is far from the nip and free from any deformation is $R\times\Delta\phi$ (R is the radius of the roller), as indicated by a vector 1012. However, since the roller surface in the nip 1011 is stretched in the circumferential direction due to deformation, as shown in FIG. 15, the moving amount of the roller surface is larger than that given by the above formula accordingly. The convey amount of the flexible medium in the nip 1011 is represented by a vector 1013. For this reason, the convey velocity in the nip 1011 becomes higher in correspondence with the stretch of the roller in the nip. This velocity variation rate changes depending on parameters such as the thickness, hardness, pressure, and the like of rubber.

As described above, a velocity at which the rollers convey the flexible medium is not uniquely determined based on the roller radius and rotational speed. In actual design, the roller convey velocity does not normally have a designed value, and suffers variations.

As one factor of convey velocity variations, an elastic member such as rubber or the like which forms the roller deforms, and the length of the circumference changes. This amount is determined by the material and hardness of the roller, the thickness of the rubber layer, that of the surface layer, the pressure, and the like, and it is essentially difficult to introduce specific numerical values from a simple formula.

There is a demand to implement behavior simulations of the tension, slack, and the like produced on the flexible medium with higher accuracy by estimating the effects of such velocity variations.

SUMMARY OF THE INVENTION

The present invention has been made to solve the conventional problems posed upon analyzing the convey behavior of a flexible medium which is conveyed in a conveying path by a computer simulation using an information processing apparatus such as a design support apparatus or the like, which can be used in design support. It is an object of the present invention to provide an information processing apparatus and its processing method, which allow even a designer who does not have expert knowledge on simulation pertaining to the modeling policy of a flexible medium in a conveying path to simulate the convey behavior of the flexible medium with relatively high accuracy.

It is another object of the present invention to provide an information processing apparatus and its processing method, which allow even a designer who does not have expert knowledge on simulation of the convey behavior of a flexible medium in a conveying path to simulate the convey behavior of the flexible medium accurately in consideration of the influence of the convey velocity variations.

In order to achieve the above object, an information processing apparatus according to the present invention has the following arrangement. That is, an information processing apparatus, which simulates a behavior of a sheet-like printing medium having a flexibility when the printing medium is conveyed in a conveying path including a convey roller pair, comprises: setting means for setting a condition including an information associated with a rigidity of the convey roller pair arranged in the conveying path; nip shape formation means for forming a shape of a contact area where the convey roller pair contact each other on the basis of the set condition; and simulation means for simulating the behavior of the printing medium when the printing medium is conveyed in the conveying path on the basis of the shape of the contact area.

An information processing apparatus according to the present invention has the following arrangement. That is, an information processing apparatus, which simulates a behavior of a sheet-like printing medium having a flexibility when the printing medium is conveyed in a conveying path including a convey roller pair, comprises: setting means for setting a condition including a position of the convey roller pair arranged in the conveying path; drive condition setting means for setting a drive condition indicating a time-series drive velocity of the convey roller pair; calculation time adjustment means for, when a time of a drive velocity change point in the drive condition does not match a calculation time, matching the calculation time with the time of the drive velocity change point; and simulation means for simulating the behavior of the printing medium when the printing medium is conveyed in the conveying path on the basis of the condition set by the setting means, the drive condition, and the matched calculation time.

A method of controlling an information processing apparatus according to the present invention has the following arrangement. That is, a method of controlling an information processing apparatus, which simulates a behavior of a sheet-like printing medium having a flexibility when the printing medium is conveyed in a conveying path including a convey roller pair, comprises: a setting step of setting a condition an information associated with including a rigidity of the convey roller pair arranged in the conveying path; a nip shape formation step of forming a shape of a contact area where the convey roller pair contact each other on the basis of the set condition; and a simulation step of simulating the behavior of the printing medium when the printing medium is conveyed in the conveying path on the basis of the shape of the contact area.

A method of controlling an information processing apparatus according to the present invention has the following arrangement. That is, a method of controlling an information processing apparatus, which simulates a behavior of a sheet-like printing medium having a flexibility when the printing medium is conveyed in a conveying path including a convey roller pair, comprises: a setting step of setting a condition including a position of the convey roller pair arranged in the conveying path; a drive condition setting step of setting a drive condition indicating a time-series drive velocity of the convey roller pair; a calculation time adjustment step of matching, when a time of a drive velocity change point in the drive condition does not match a calculation time, the calculation time with the time of the drive velocity change point; and a simulation step of simulating the behavior of the printing medium when the printing medium is conveyed in the conveying path on the basis of the condition set by the setting means, the drive condition, and the matched calculation time.

An information processing apparatus according to the present invention has the following arrangement. That is, an information processing apparatus, which simulates a behavior of a sheet-like printing medium having a flexibility when the printing medium is conveyed in a conveying path, comprises: definition means for defining a convey roller pair to be arranged in the conveying path; and display means for displaying an input screen used to input a parameter required to calculate a velocity variation rate caused by deformation of a convey roller with respect to the defined convey roller pair.

A method of controlling an information processing apparatus according to the present invention has the following arrangement. That is, a method of controlling an information processing apparatus, which simulates a behavior of a sheet-like printing medium having a flexibility when the printing medium is conveyed in a conveying path, comprises: a definition step of defining a convey roller pair to be arranged in the conveying path; and a display step of displaying an input screen used to input a parameter required to calculate a velocity variation rate caused by deformation of a convey roller with respect to the defined convey roller pair.

According to the information processing apparatus of the present invention, upon analyzing the behavior of a flexible medium which is conveyed in a conveying path by a computer simulation, even a designer who does not have expert knowledge on simulation pertaining to the modeling policy of the flexible medium can analyze with relatively higher accuracy.

In the simulation, since a feature point of a drive chart is matched with a calculation step, even a designer who does not have expert knowledge on simulation can analyze with relatively higher accuracy.

In the simulation, since the behavior simulation of a flexible medium is made in consideration of the influence of convey velocity variations of the flexible medium, even a designer who does not have expert knowledge on simulation can analyze with relatively higher accuracy.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 21 shows an example of a window used to input respective parameters of the convey roller pair;

DETAILED DESCRIPTION OF THE PREFERRED EMBODIMENTS

Preferred embodiments of the present invention will now be described in detail in accordance with the accompanying drawings.

A design support apparatus as an example of an information processing apparatus which can be used in design support, and its control method of the present invention will be described hereinafter with reference to the accompanying drawings. Note that the present invention is not limited to embodiments to be described below, and modifications and combinations may be made as needed within the scope of the present invention.

First Embodiment (Overview of this Embodiment)

A design support apparatus of this embodiment is characterized in that, upon analyzing the convey behavior of a flexible medium conveyed in a conveying path by a simulation, an accurate simulation can be implemented by executing the following three processes: 1) a process for approximating a nip on a model to an actual nip; 2) a process for matching a feature point of a drive chart with a calculation step in numerical calculation for solving the motion of the flexible medium using a drive chart; and 3) a process for reflecting velocity variations due to deformation of a convey roller pair. As a result, when the design support apparatus of this embodiment is used, even a designer who does not have expert knowledge on simulation can analyze the convey behavior of a flexible medium conveyed in a conveying path with relatively high accuracy. The hardware arrangement of the design support apparatus of this embodiment and the processing methods 1), 2), and 3) using the design support apparatus will be described in detail below.

Figure 1:
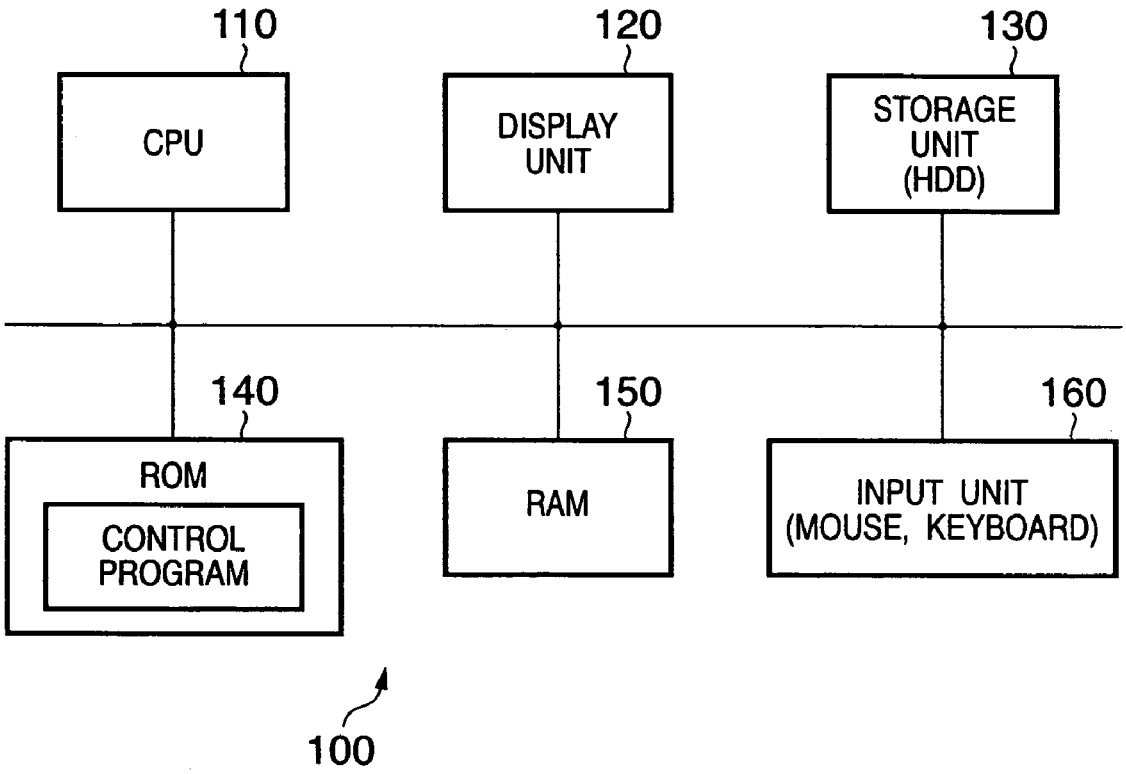
FIG. 1 is a schematic block diagram showing the hardware arrangement of a design support apparatus of the present invention.

<Hardware Arrangement of Design Support Apparatus: FIG. 1>

The arrangement of the design support apparatus will be described first. FIG. 1 is a schematic block diagram showing an example of the hardware arrangement of a design support apparatus 100 as one of information processing apparatuses of the present invention. The design support apparatus 100 comprises a CPU 110, display unit 120, storage unit 130, ROM 140, RAM 150, input unit 160, and the like. The CPU 110 is a central processing unit which controls the overall design support apparatus 100, and the display unit 120 displays various input conditions, analysis results, and the like of this embodiment. The storage unit 130 is a hard disk or the like, which saves the analysis results and the like of this embodiment. The ROM 140 stores a control program of this embodiment, various application programs, data, and the like. The RAM 150 is a work area used when the CPU 110 executes processing while controlling respective units on the basis of the control program. The input unit 160 includes a keyboard, mouse, and the like.

<1. Processing for Approximating Nip on Model to Actual Nip>

Figure 2:
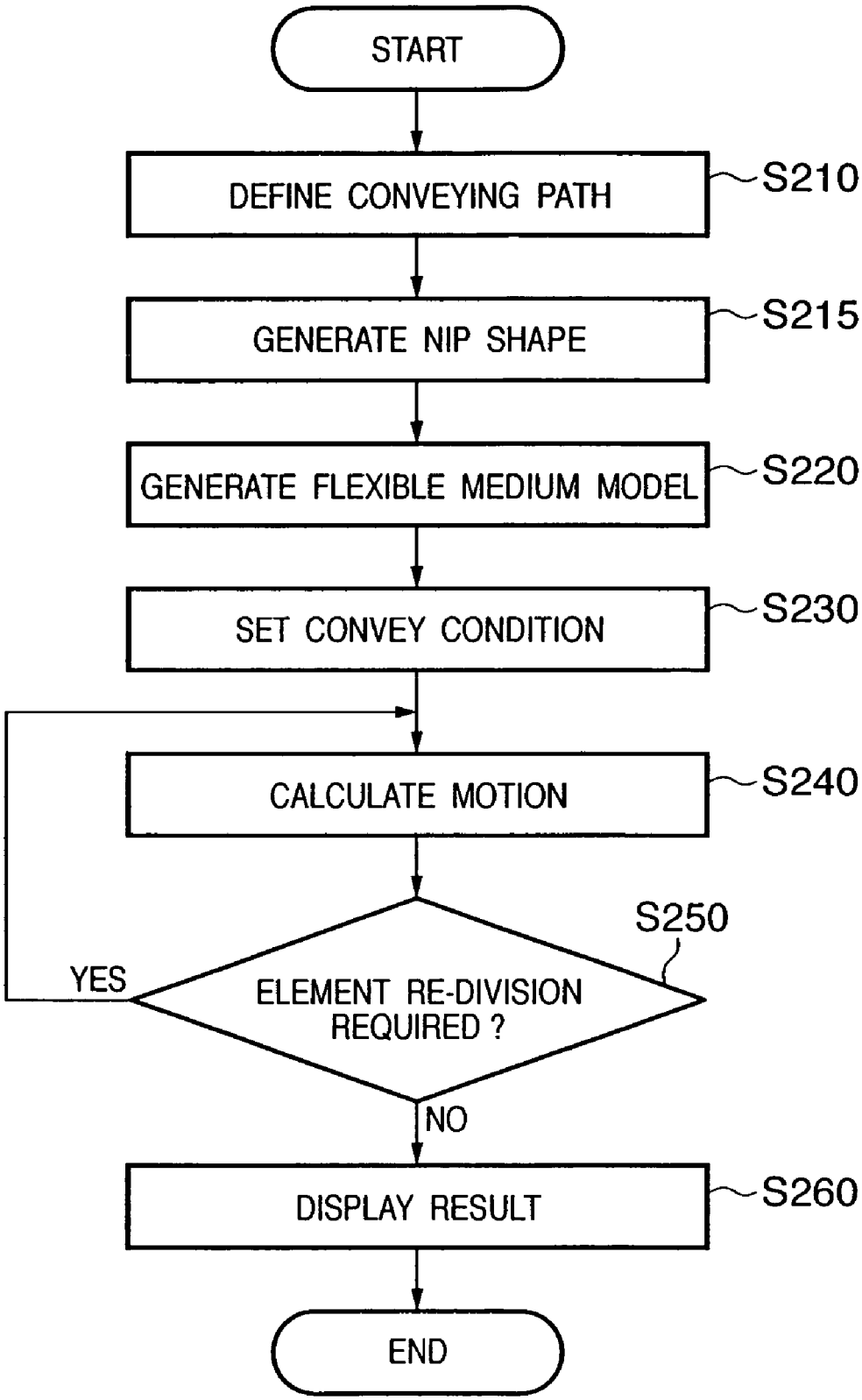
FIG. 2 is a flowchart showing the process for accurately simulating the behavior of a flexible medium conveyed in a conveying path by approximating a nip on a model in the design support apparatus of the present invention to an actual nip.

[Processing of Design Support Apparatus: FIG. 2]

An example of the flow of processing when the behavior of a flexible medium conveyed in a conveying path is accurately analyzed by a computer simulation by approximating a nip on a model to an actual nip in the design support apparatus 100 of this embodiment will be described below using the flowchart shown in FIG. 2. The CPU 110 executes the design support processing shown in FIG. 2 while controlling respective units on the basis of the control program stored in the ROM 140.

In conveying path definition step S210, the positions, shapes, and the like of building parts such as convey guides, convey rollers, and the like, which form a conveying path are set from a display screen displayed on the display unit. Also, information pertaining to the rigidities of a convey roller pair (e.g., information indicating that the rigidity of one roller is higher than the other roller, and that roller is considered as a rigid roller, information indicating that the two rollers have substantially the same rigidities, and cannot be considered as rigid rollers, or the like) is set. The display screen displays the positions, shapes, and the like of building parts on the basis of the set conditions. This point will be described in detail later.

Upon completion of conveying path definition step S210, the flow advances to nip shape generation step S215. In this step S215, the nip shape of the convey roller pair is calculated on the basis of the input information associated with the shapes and rigidities of the convey roller pair. This point will be described in detail later.

Upon completion of nip-shape generation step S215, the flow then advances to flexible medium model generation step S220. Information required for or related to a simulation required for flexible model generation in step S220 is input from a display screen displayed on the display unit 120. The input information includes the type and shape of a flexible medium, and the number of divisions of the flexible medium model, a division method, and the like as flexibility information. Based on the input information, a flexible medium is divided into a plurality of rigid elements having masses, and a flexible medium model expressed as an elastic member that couples the rigid members by springs is generated. This point will be described in detail later. Upon completion of flexible medium model generation step S220, the flow advances to convey condition setting step S230. In convey condition setting step S230, the drive conditions such as drive timings, drive velocities, and the like required to convey the flexible medium such as a drive method of building parts (e.g., convey roller pair) arranged in the conveying path, are set. This drive method is given by, e.g., a drive chart. This drive chart is set with drive conditions indicating the time-series drive velocities of building parts. In the convey condition settings, coefficients of friction between the convey roller pair and convey guides, and the flexible medium, and the like can be set.

Upon completion of convey condition setting step S230, the flow advances to motion calculation step S240. In motion calculation step S240, an equation of motion is numerically analyzed on the basis of the generated nip shape, the flexible medium model expressed as an elastic member, the drive conditions of building parts, and the like. The behavior when the flexible medium (expressed as the flexible medium model) is conveyed in the conveying path is obtained in chronological order by a numerical simulation. Also, the bending moment of the flexible medium obtained by the numeral simulation of the behavior of the flexible medium is calculated.

Upon completion of motion calculation step S240, it is checked if element re-division is further required (step S250). It is checked in element re-division step S250 whether or not appropriate element division is made to obtain an adequate solution using the bending moment of the flexible medium calculated in step S240 as an index. As a practical example of a problem, the element division of the flexible medium is coarse (element length is large). In such case, the bending moment of the flexible medium assumes a large value which is impossible in practice during the motion calculation, and a false behavior solution is calculated. Hence, a case will be examined below wherein the flexible medium is assumed to be a paper sheet used in an ink-jet printer or the like.

A case will be exemplified wherein a paper sheet with a thickness of 0.3 mm and Young's modulus of 8,000 MPa is used as such paper sheet. Also, a case will be assumed wherein the paper sheet passes through a conveying path including a bent path with a radius of 5 mm in the printer. In such case, if many tests have shown that the maximum value of the bending moment in the portion of the bent path is about 600 gfmm, 6,000 gfmm as a value 10 times of this bending moment is set as a threshold of necessity decision of element re-division. With such setting, the calculation time can be prevented from being prolonged without any extra re-division. Note that the above threshold is an example, and can be appropriately set according to the calculation processing performance, required accuracy, and the like.

If it is determined in step S250 that flexible medium re-division is required, the rigid elements are divided further finely, and the flow is controlled to return to step S240. On the other hand, if it is determined in step S250 that the evaluation result of the bending moment of the flexible medium is appropriate in terms of accuracy, the flow is controlled to advance to step S260. Note that the bending moment of the flexible medium is evaluated by comparing the analyzed bending moment value with its pre-set value, and if the analyzed bending moment value falls outside the pre-set allowable range, it is determined that the evaluation result is inappropriate in terms of accuracy.

If it is determined in step S250 that no element re-division is required, the flow advances to result display step S260 to display the arithmetic result. In step S260, the behavior of the flexible medium as the analysis result obtained by the numerical simulation by means of the motion calculation is displayed on the display unit 120.

Figure 3:
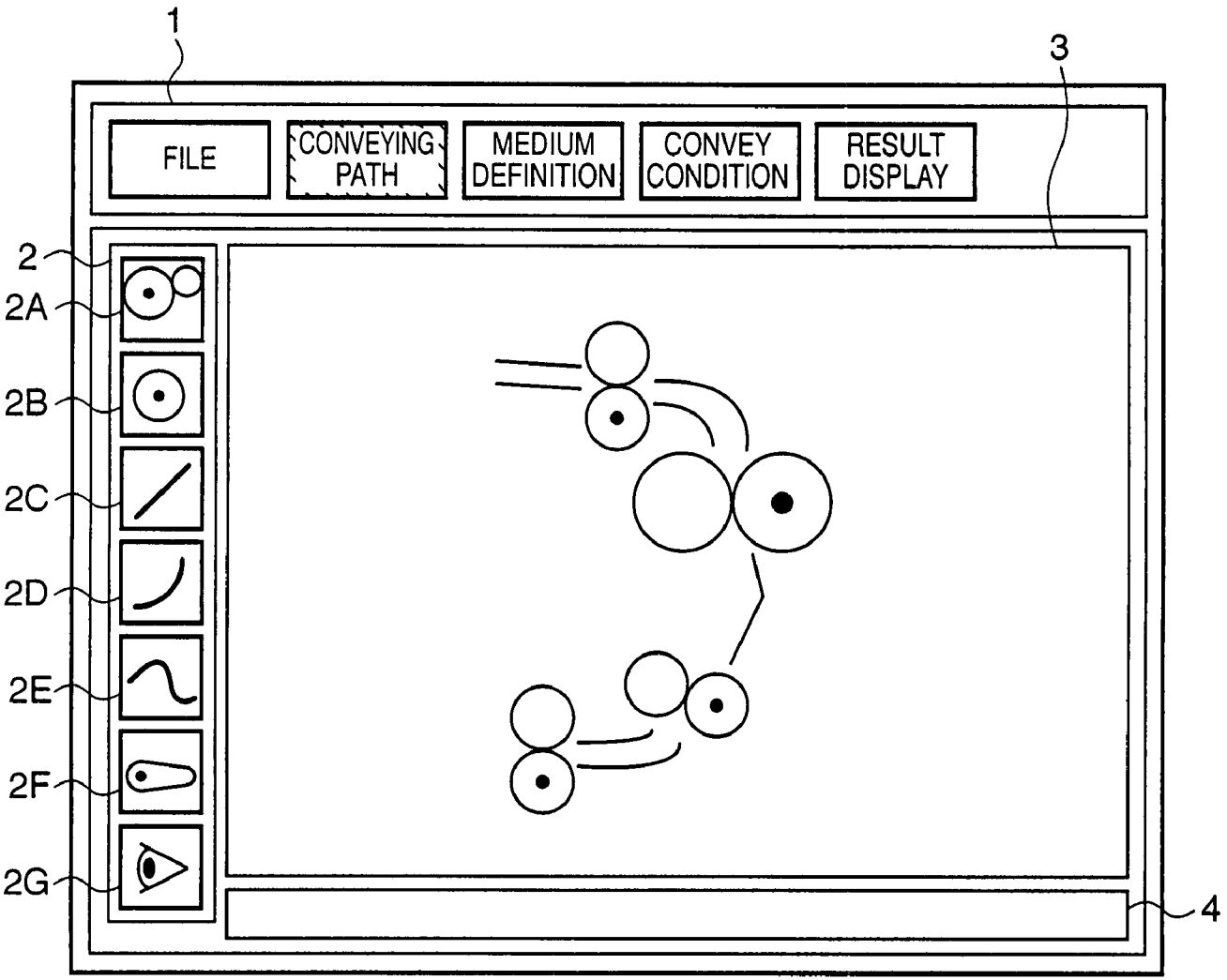
FIG. 3 shows an example of the screen configuration (conveying path definition) displayed on a display unit of the design support apparatus of the present invention.

[Conveying Path Definition: FIG. 3]

The conveying path definition and flexible medium model generation processes as characteristic features of the present application in FIG. 2 described above will be described in detail below. FIG. 3 shows an example of the screen configuration displayed on the display unit when the design support apparatus 100 is launched. The screen shown in FIG. 3 includes a menu bar 1, a sub-component menu 2 of each process, a graphic area 3, a command field 4, and the like. The menu bar 1 is mainly used to switch the processes described in FIG. 2. The graphic area 3 displays the defined conveying path, analysis result, and the like. The command field 4 is used to output a system message and to input numerical values as needed.

The conveying path definition process in step S210 in FIG. 2 will be described in detail first. The conveying path definition process starts upon detection of depression of a "conveying path" button in the menu bar 1 in FIG. 3 by the user. If the button depression is recognized, the display color of "conveying path" is reversed to indicate that the "conveying path" button is selected, and the sub-component menu 2 of the "conveying path" process is displayed, as shown in FIG. 3.

The sub-component menu 2 includes a roller pair definition button "2A", roller definition button "2B", straight line guide definition button "2C", arc guide definition button "2D", spline guide definition button "2E", flapper definition button "2F", and sensor definition button "2G".

The roller pair definition button "2A" defines a pair of convey rollers using two rollers, and the roller definition button "2B" defines one roller alone. The straight line guide definition button "2C" defines a straight line convey guide, and the arc guide definition button "2D" defines an arc convey guide. The spline guide definition button "2E" defines a convey guide using a spline curve, and the flapper definition button "2F" defines a flapper (point) which branches paths on which the flexible medium is conveyed. The sensor definition button "2G" defines a sensor for detecting whether or not the flexible medium is located at a predetermined position in the conveying path. In the sub-component menu 2, parts required to form the conveying path of an actual copying machine or printer are prepared. Hence, when respective building parts are defined using the sub-component menu 2, their positions and shapes are reflected on the graphic area 3. The graphic area 3 in FIG. 3 displays a definition example of the conveying path using the sub-component menu 2.

Figure 4:
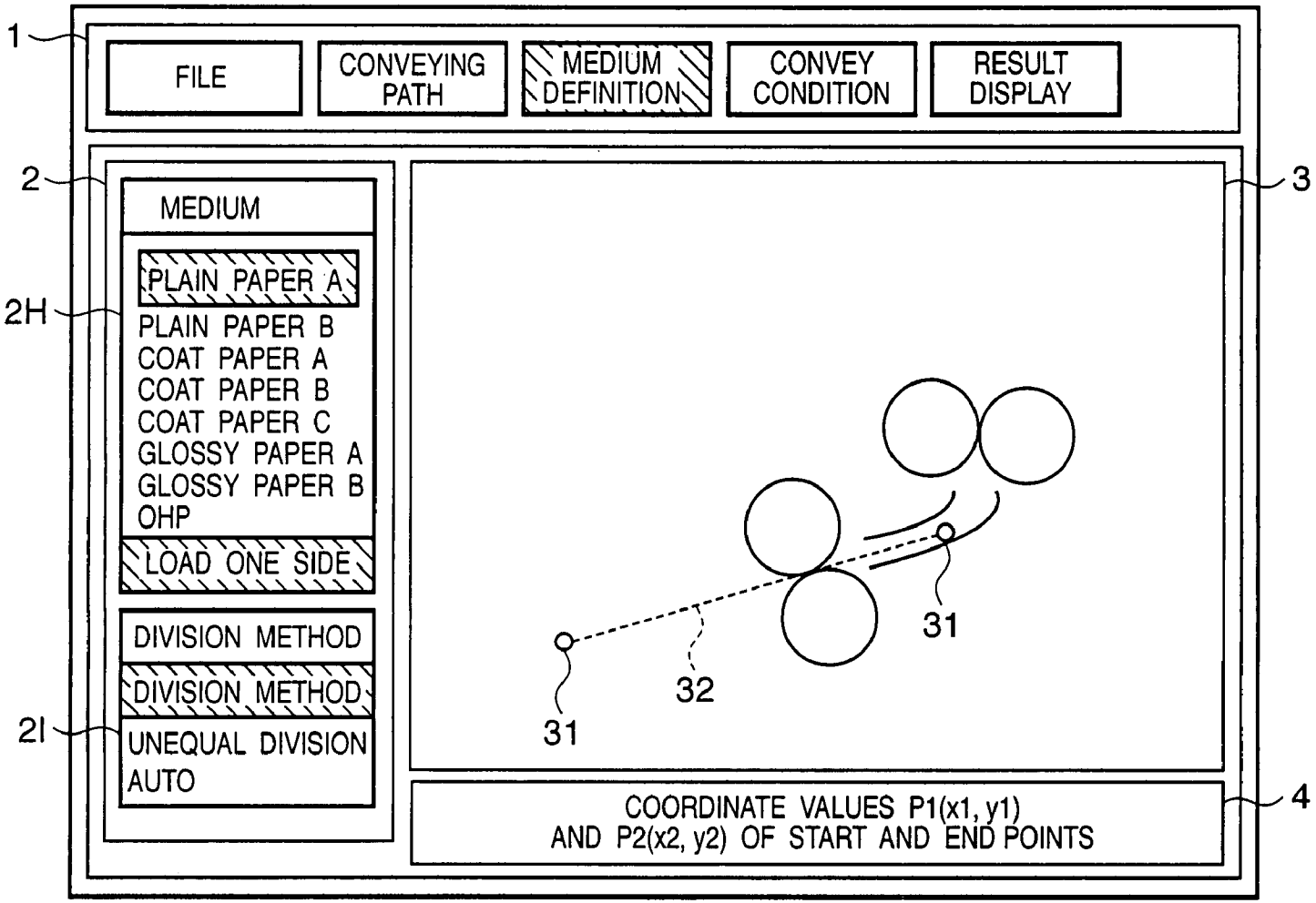
FIG. 4 shows an example of a screen configuration (medium definition) displayed on the display unit of the design support apparatus of the present invention.

[Flexible Medium Model Generation: FIG. 4]

Upon completion of the conveying path definition by the aforementioned conveying path definition means, the control then transits to the flexible medium model generation process. Transition to the flexible medium model generation process starts upon detection of depression of a "medium definition" button in the menu bar 1 by the user, and the display color of "medium definition" is reversed to indicate that the "medium definition" button is selected. At the same time, a medium type selection area 2H and division method selection area 2I are displayed as the sub-component menu 2 of the "medium definition" process on the left side of the graphic area 3, as shown in FIG. 4. Next, as shown in FIG. 4, a message that prompts the user to input coordinate values P1(x1, y1) and P2(x2, y2) of the two ends of the flexible medium is displayed on the command field 4 so as to determine the position of the flexible medium in the conveying path. The user inputs the coordinate values P1 and P2 as numerical values in the command field 4 or directly designates their positions on the graphic area 3 using a pointing device such as a mouse or the like attached to the design support apparatus 100 of this embodiment, in accordance with the message. Of course, the user can input by combining these means. When the coordinates of the two ends P1 and P2 are specified (input), a straight line (broken line shown in FIG. 4) 32 that connects two ends 31 is drawn on the graphic area 3, thus allowing the user to confirm the location of the flexible medium in the conveying path. The graphic area 3 in FIG. 4 displays the state at that time (when the coordinate values of the two ends P1 and P2 are input, and the straight line 32 that connects the two ends 31 are drawn).

Next, a message that prompts the user to input the number n of divisions required upon discretizing the flexible medium expressed by the straight line (broken line shown in FIG. 4) 32 into a plurality of spring-mass systems is displayed on the command field 4 (not shown). The user inputs the number n of divisions in the command field 4 in accordance with the displayed message. The example of this embodiment indicates that the user selects equal division using the division method selection area 2I shown in FIG. 4. As the number of divisions at that time, for example, a value "10" is input from the command field 4 when the flexible medium is divided into ten.

Also, the user selects the type of flexible medium using the medium type selection area 2H shown in FIG. 4. In this case, typical paper type names are registered in advance in the medium type selection area 2H, and the user can select a desired flexible medium by clicking the type of flexible medium to be calculated. Note that calculation parameters required to calculate the motion of the flexible medium in the conveying path using the design support apparatus 100 of this embodiment include information such as the Young's modulus, density, and thickness of the flexible medium. To these kinds of information, calculation parameters are assigned as a database for each paper type displayed within the medium type selection area 2H. This database is pre-stored in the ROM 140, storage unit 130, or the like. In the example of FIG. 4, when the user presses a "plain paper A" button, the values of the Young's modulus, density, and paper thickness of "plain paper A". required in the behavior calculation of the flexible medium are quoted from the database in the design support apparatus 100. For example, values of 5,409 Mpa as the Young's modulus of "plain paper A", 1.25 g/cc as the density, and 0.0951 mm as the paper thickness are quoted from the database.

Figure 5:
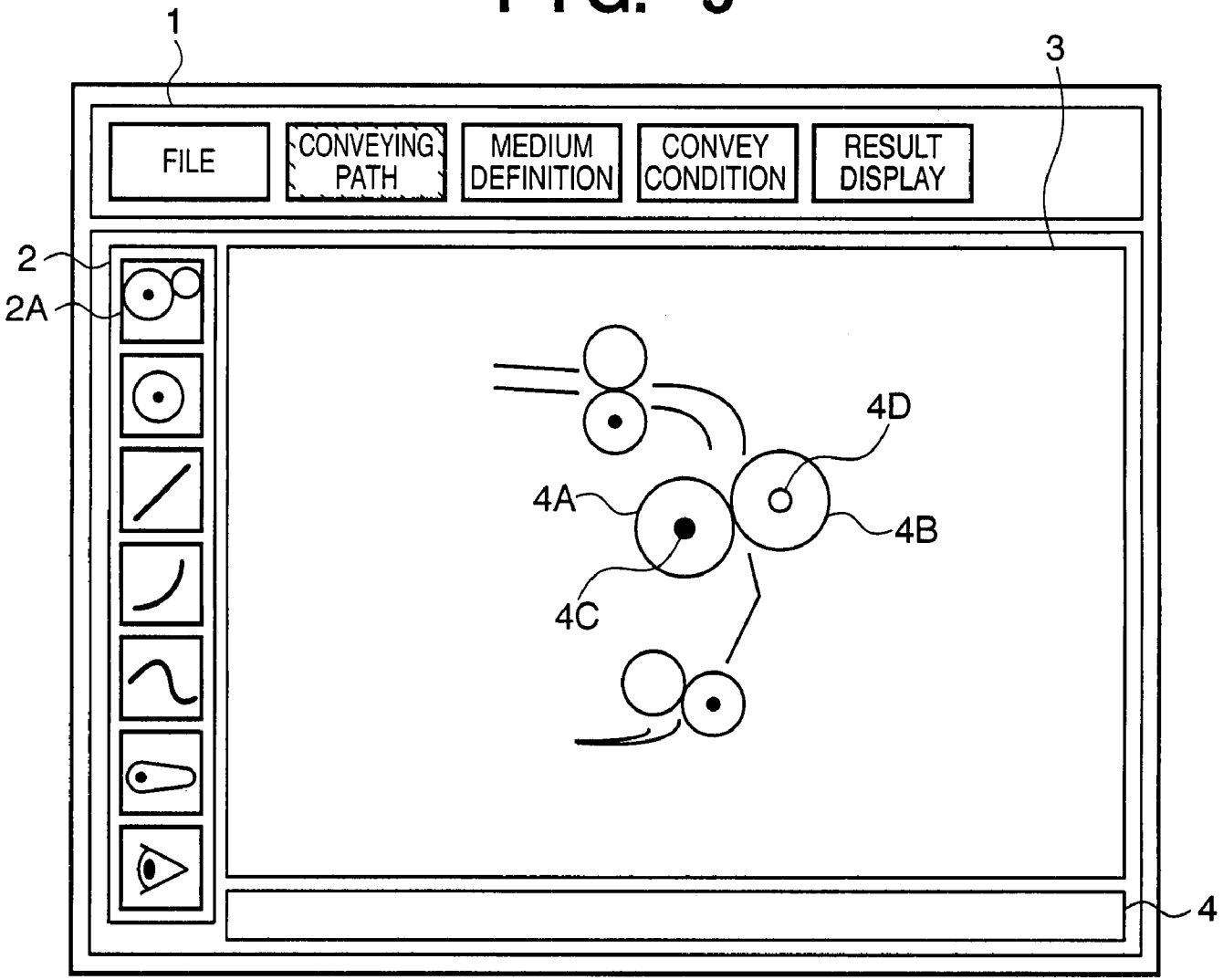
FIG. 5 is a view for explaining designation of the shapes of a convey roller pair in conveying path processing.
Figure 6:
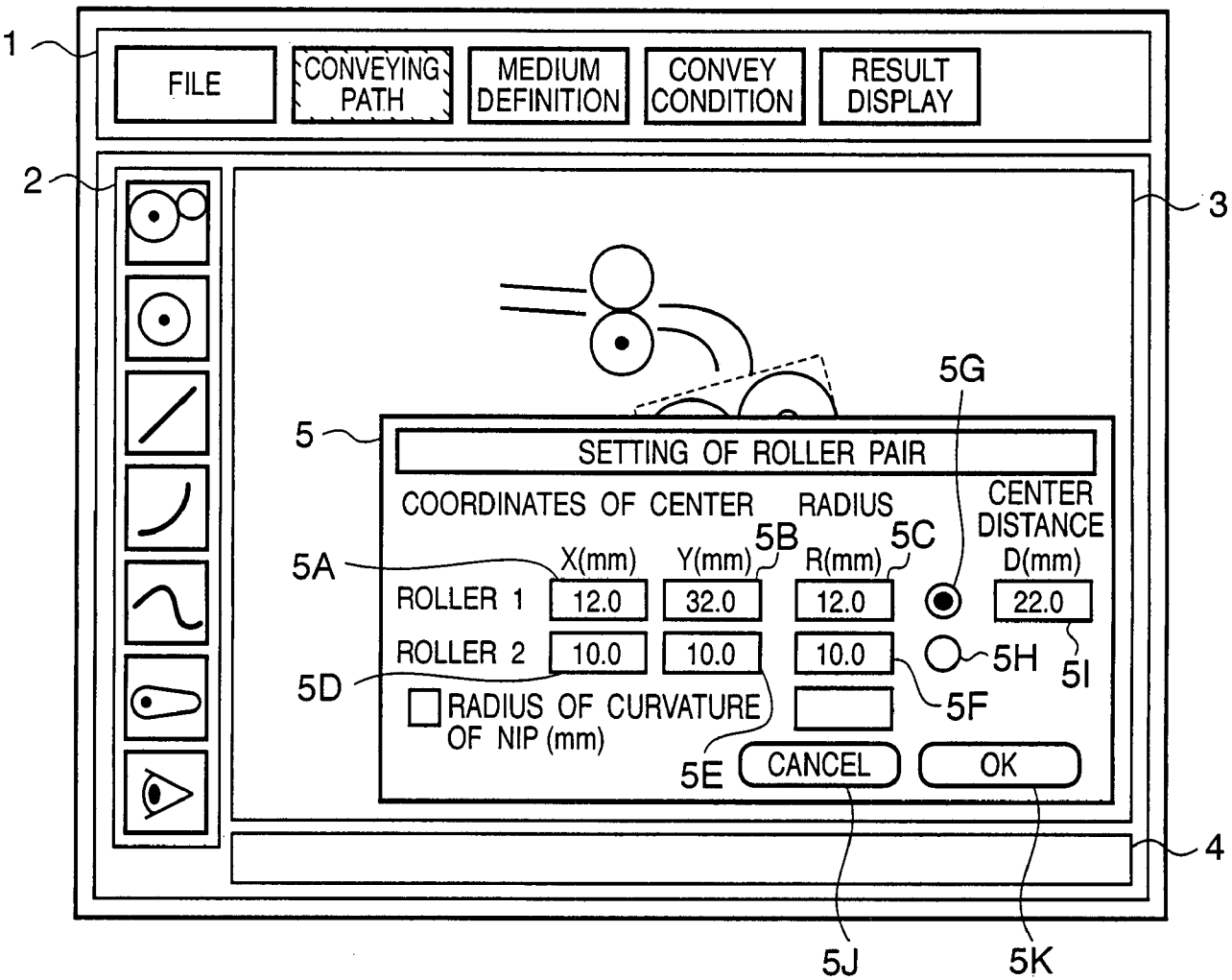
FIG. 6 is a view for explaining detailed settings of the convey roller pair in the conveying path processing.

[Setting Sequence of Nip Shape of Convey Roller Pair (When One Roller is Rigid Body): FIGS. 5 and 6]

An example of the sequence for setting the nip shape of the convey roller pair will be explained below. A case will be exemplified below wherein one convey roller of the convey roller pair has a sufficiently higher rigidity than the other convey roller, and a nip matches the shape of this rigid roller (when one roller is a rigid body).

This setting starts when the user presses the "conveying path" button in the menu bar 1 shown in FIG. 5 and also presses the roller pair definition button "2A" in the sub-component menu 2 of the "conveying path" process, and the user can set the convey roller pair on the graphic area 3. In this case, the user designates the shapes of a convey roller pair including rollers 4A and 4B shown in FIG. 5 on the graphic area 3 using a pointing device such as a mouse or the like attached to the design support apparatus 100 of this embodiment.

An example of the designation method will be described below. The user clicks and determines a central position 4C of the convey roller 4A on the graphic area 3. The user then moves the pointing device to one point on the outer periphery separated by a radius of the convey roller 4A, and clicks it to set the radius of the roller. In this manner, the convey roller 4A is determined. Next, the user moves the pointing device to a central position of the convey roller 4B, and clicks it to determine a central position 4D of the opposing convey roller. Since the opposing convey roller contacts the reference convey roller 4A, the radius of that roller is automatically determined. In this way, the convey rollers 4A and 4B are defined on the graphic area 3. At this time, however, the accurate positions and radii of the two convey rollers are not determined, and the two rollers are temporarily set. Also, no nip between the convey rollers is defined.

Figure 8:
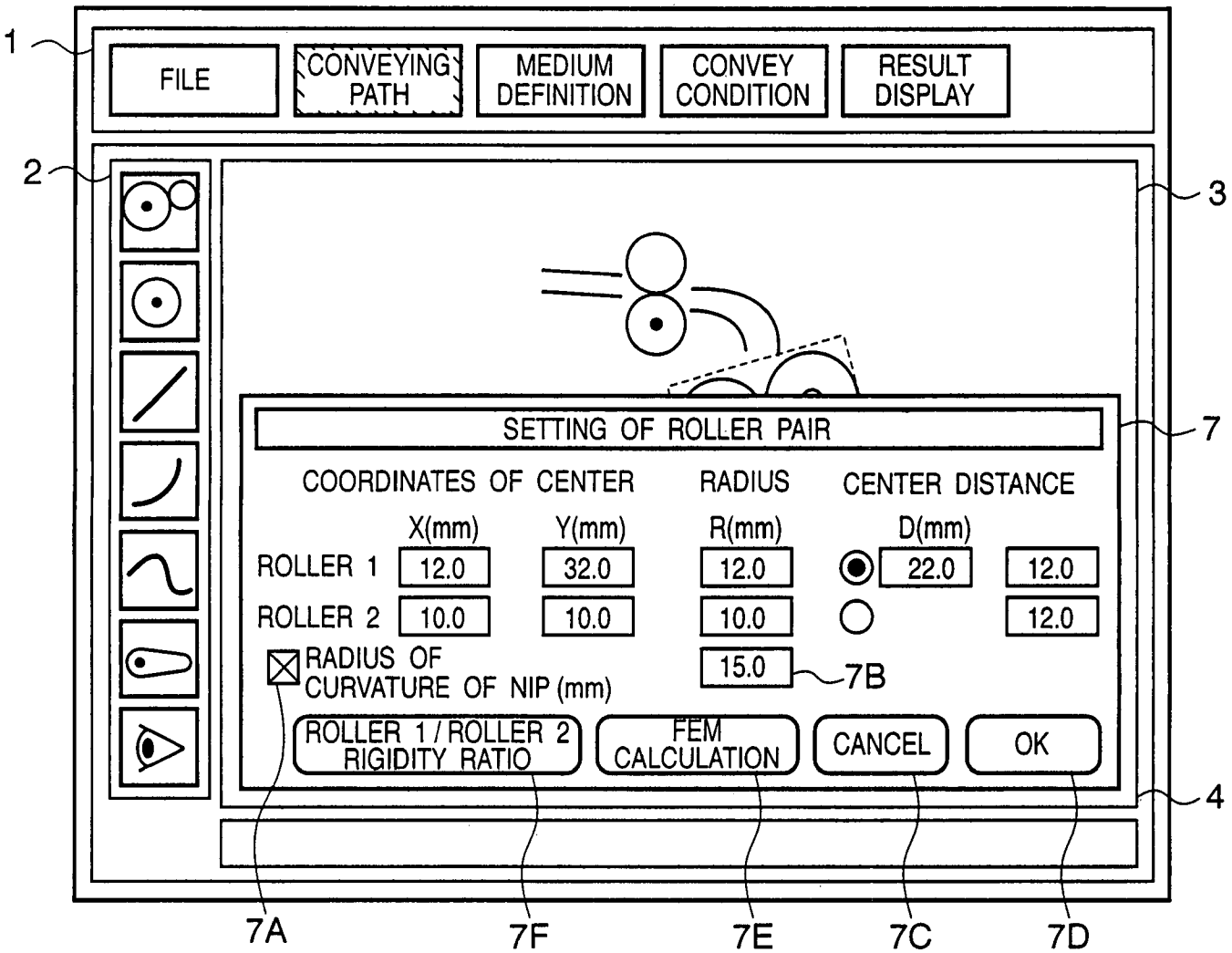
FIG. 8 is an explanatory view for designating the shapes of another convey roller pair in the conveying path processing (when neither rollers are complete rigid bodies)

When the pair of convey rollers 4A and 4B on the graphic area 3 shown in FIG. 5 are selected by, e.g., double-clicking, a convey roller pair setting window 5 shown in FIG. 6 (or FIG. 8) appears on the graphic area 3. On the window 5 shown in FIG. 6, roller 1 represents the convey roller 4A set first, and roller 3 represents the convey roller 4B set next. The window 5 includes input fields that allow the user to designate an X-coordinate 5A and Y-coordinate 5B of the center, and a radius 5C of roller 1, and an X-coordinate 5D and Y-coordinate 5E of the center, and a radius 5F of roller 2 using numerical values, as shown in FIG. 6. When the window 5 appears, respective values at the present time are input to these fields. When these values are to be finely adjusted, accurate values can be substituted in the input fields. A distance between the centers of the two rollers is automatically input to a field 5I indicating the center distance of the two convey rollers. The window 5 in FIG. 6 (e.g., a display screen when a rigidity ratio of the convey roller pair is 10 or more, and one of the convey roller pair is considered as a rigid body) does not display any rigidity ratio. However, an input field of the rigidity ratio between rollers 1 and 2 may be displayed, and the rigidity ratio may be input. Also, required values may be input using a convey roller pair setting window 7 in FIG. 8 in place of FIG. 6. The window 7 shown in FIG. 8 is similar to the window 5 in FIG. 6, but it displays a roller 1/roller 2 rigidity ratio 7F and FEM calculation 7E unlike in FIG. 6. Since details of these fields will be described, a description thereof will be omitted here.

Next, a nip (contact area of the convey roller pair) is defined. An actual nip shape (arc) is determined by the rigidities of the roller pair and the center distance of the roller centers. The nip shape definition of the present invention can be set while being classified into two cases depending on the rigidity difference of the two rollers. For example, when the roller rigidities are apparently different like a metal roller (high rigidity roller) and rubber roller (low rigidity roller) and the rigidity ratio of the two rollers is large, a nip shape is defined so that deformation of the roller with a lower rigidity follows the shape of the roller with a higher rigidity. On the other hand, when the two rollers have nearly equal rigidities, and the magnitude relationship of the rigidity ratio is not clear, a nip shape cannot be uniquely determined. Hence, a nip shape is set to be defined according to the rigidity ratio.

In the present invention, buttons 5G and 5H are a pair of radio buttons and one of these buttons can be selected for the sake of convenience. In this case, the roller with a higher rigidity which abuts along the nip shape is selected. In the example of FIG. 6, roller 1 is selected (the rigidity of the convey roller 4A is higher than that of the convey roller 4B). A center distance when a nip is formed by receiving a pressure is input to the field 5I. Since the center distance input to the field 5I assumes a value smaller than the sum of the radii of the two rollers, the center coordinate values 5D and 5E of roller 2 are automatically corrected in a direction toward the center of roller 1.

As another designation method, the center coordinates of the two rollers in a pressed state may be designated. In this case, the center distance calculated from the center coordinates is automatically input to the field. Upon completion of the input operations so far, the user clicks an "OK" button 5K to fix setting values, thus closing the window 5. When the user wants to cancel settings, he or she clicks a "cancel" button 5J.

Figure 7:
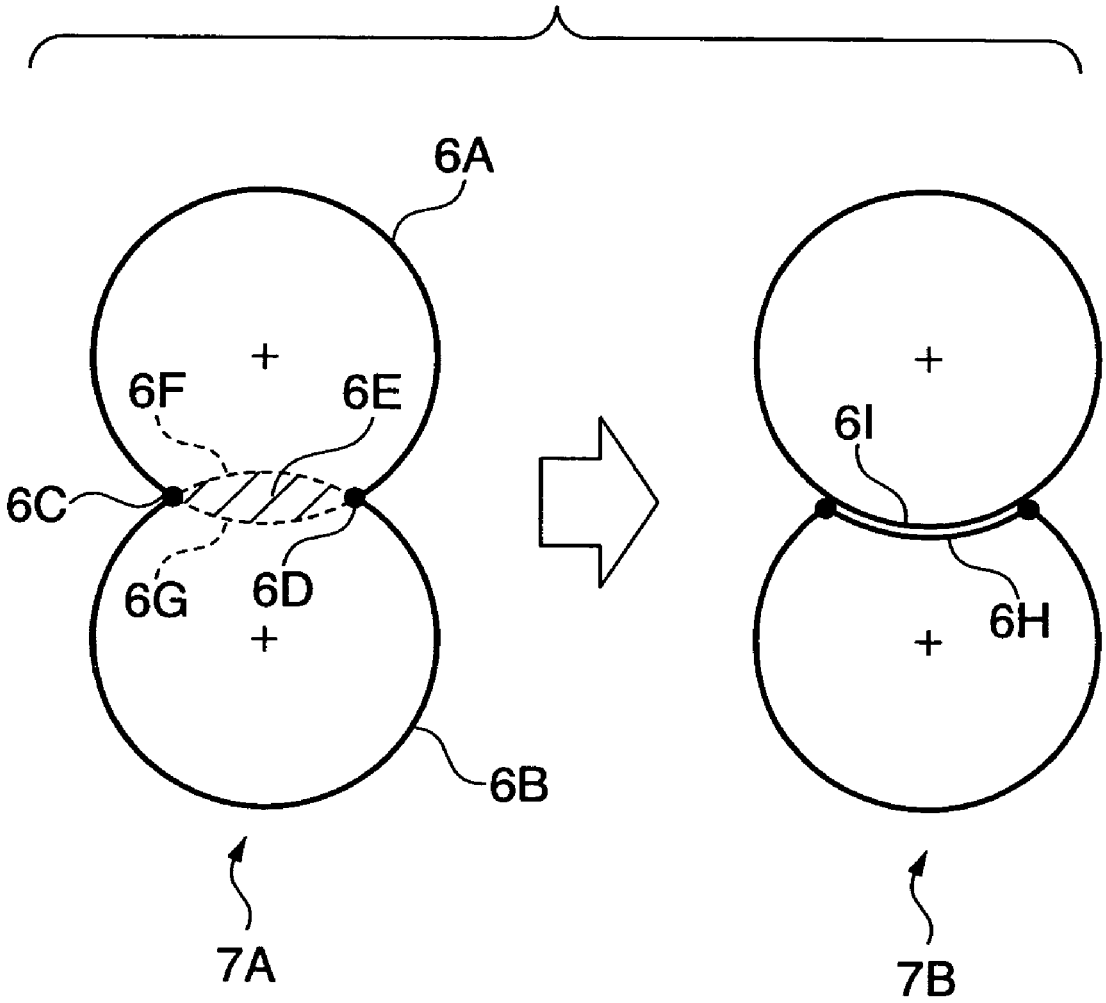
FIG. 7 is a view for explaining formation of a nip shape of the convey roller pair (when one roller is a rigid body)

[Formation of Nip Shape of Convey Roller Pair (When One Roller is Rigid Body): FIG. 7]

An example of the nip shape setting sequence when the rigidity ratio of the two convey rollers is large will be explained below. 7A of FIG. 7 shows an example of a roller pair drawn based on the setting values on the window 5. In this example, a roller 6A corresponds to roller 1 (roller 1 with a higher rigidity in FIGS. 5 and 6), and a roller 6B corresponds to roller 2 (roller 2 with a lower rigidity in FIGS. 5 and 6). Since the center distance that forms a nip is set in 7A of FIG. 7, the rollers have intersections at points 6C and 6D, and an overlapping portion 6E is formed. In the above settings, since roller 1 is designated as a rigid roller, a nip abuts along an arc 6G on the roller 1 side, and a portion of an arc 6F is cut at the points 6C and 6D. Then, as shown in 7B of FIG. 7, an arc 6H obtained by copying the arc 6G intact in place of the cut arc 6F is formed on the roller 6B. A portion between a circumference 6I of roller 1 and an arc 6H of roller 2 formed in this manner is defined as a nip through which the flexible medium passes. Note that 7B of FIG. 7 illustrates the circumference 6I and arc 6H to have a gap (to be spaced) for the sake of easy understanding, but they overlap on a single line in an actual model.

In this embodiment, whether or not a convey roller pair include a rigid roller and non-rigid roller (a roller softer than the rigid roller) is checked by seeing if the pre-set rigidity ratio of the convey roller pair exceeds a given value, and such convey roller pair are determined in accordance with the checking result. That is, the nip (contact area of the convey roller pair) shape of the convey roller pair is formed so that the surface shape of one roller abuts along that of the other roller. Next, a portion where one roller overlaps the other roller is cut, and an arc that abuts along the surface shape of the other roller is generated on the cut portion, thus forming the shape of the contact area of the convey roller pair. In this embodiment, if the rigidities of the two rollers have a difference of 10 times or more as the rigidity ratio, the shape of one roller is formed to abut along the surface shape of the other roller. Of course, this criterion is an example of this embodiment, and this value need not always be used. On the other hand, a threshold to be checked may be changed as needed like in a case wherein rigidities have a difference that exceeds 10 times.

This threshold may be permanently set or may be changed as needed from the setting screen. If aspect changes due to aging and the like of the coefficient of friction and elasticity of the surface of the convey roller are to be taken into consideration, it is desirable to change the threshold. Also, the threshold may be automatically changed depending on conditions. Such change may be made by popping up a new criterion setting screen, or may be input together with rigidity values as one of the setting conditions of the roller pair shown in FIG. 6 or 8. In the present invention, the rigidity may be expressed by a surface deformation amount when a given force is applied from the surface of the roller toward the center. More specifically, a moving amount a of the surface in the center direction when the surface is pressed by force 1N toward the center direction may be used as a rigidity value. Of course, the rigidity may be evaluated by other parameters that can express a deformation amount (e.g., Young's modulus). However, in consideration of the influence and the like of the thickness of a tubular component of aluminum or the like that forms the roller, it is reasonable to express the rigidity value by the deformation amount.

As described above, when one convey roller of the convey roller pair has a sufficiently higher rigidity than the other convey roller, and a nip matches the shape of this rigid roller (when one roller is a rigid body), the conveying path definition processing is executed as follows. That is, upon defining a convey roller pair having a contact area in the conveying path definition processing, the nip shape is defined to abut along the surface shape of either one roller. A portion where the convey roller which is not selected as the one that abuts along the nip overlaps the selected convey roller is cut, and an arc that abuts along the shape of the selected convey roller is formed on that portion, thus defining a portion between this arc and the selected convey roller as a nip. That is, the shape of the roller with a higher rigidity remains unchanged, and an arc is set so that the surface shape of the roller with a lower rigidity is deformed along the shape of the roller with the higher rigidity, thus defining a portion between the original shape and the set arc of these rollers as a nip. The flexible medium such as a paper sheet or the like is located between the original shape portion and the set arc portion of these rollers, and is clamped and conveyed by the roller pair.

Obviously, the radius of curvature of the arc that represents the nip shape desirably matches that of a circle that represents the rigid roller. However, since an error in the graphic processing by means of a computer calculation may be assumed, if an error of the radii of curvature of the arc and circle falls within 5%, the nip shape falls within the range of the shape that abuts along the surface shape of the roller. More specifically, this nip allows the flexible medium which is expressed as an elastic member by coupling a plurality of rigid elements having masses via springs to pass through it. With this processing upon making a numerical simulation of the behavior of a flexible medium in case of the roller arrangement in which two rollers have different rigidities and one roller has a sufficiently higher rigidity than the other, a nip on a model can be approximated to an actual nip. For this reason, the behaviors such as deformation, entry and exit angles, and the like of the flexible medium can be accurately calculated.

In the convey condition setting processing, since the diameters of the rollers and their center distance are input, and the roller which abuts along the nip shape is selected, the aforementioned nip shape can be automatically set. For this reason, the operation of the design support apparatus of this embodiment is facilitated, and the number of design steps of the user can be reduced.

In the design support apparatus 100 of this embodiment, the nip of the convey roller pair having different rigidities (when one roller is a rigid body) is formed by the circumference 6I of roller 1 with a higher rigidity and the arc 6H of roller 2 with a lower rigidity, as shown in 7B of FIG. 7. At this time, the nip shape considers deformation of the roller. Compared to the nip shape of the convey roller pair, which is formed by defining the overlapping portion by a straight line in the conventional design support apparatus, i.e., that defined by a straight line which connects the points 6C and 6D in 7A of FIG. 7, this nip shape can approximate the nip on the model to an actual nip more accurately. For this reason, when the nip shape set by the design support apparatus 100 is used, even a user who does not have expert knowledge on simulation pertaining to the modeling policy of a printing medium can analyze the behavior of a printing medium conveyed in a conveying path with relatively higher accuracy.

[Setting Sequence of Nip Shape of Convey Roller Pair (when Neither Rollers are Complete Rigid Bodies): FIG. 8]

Figure 9:
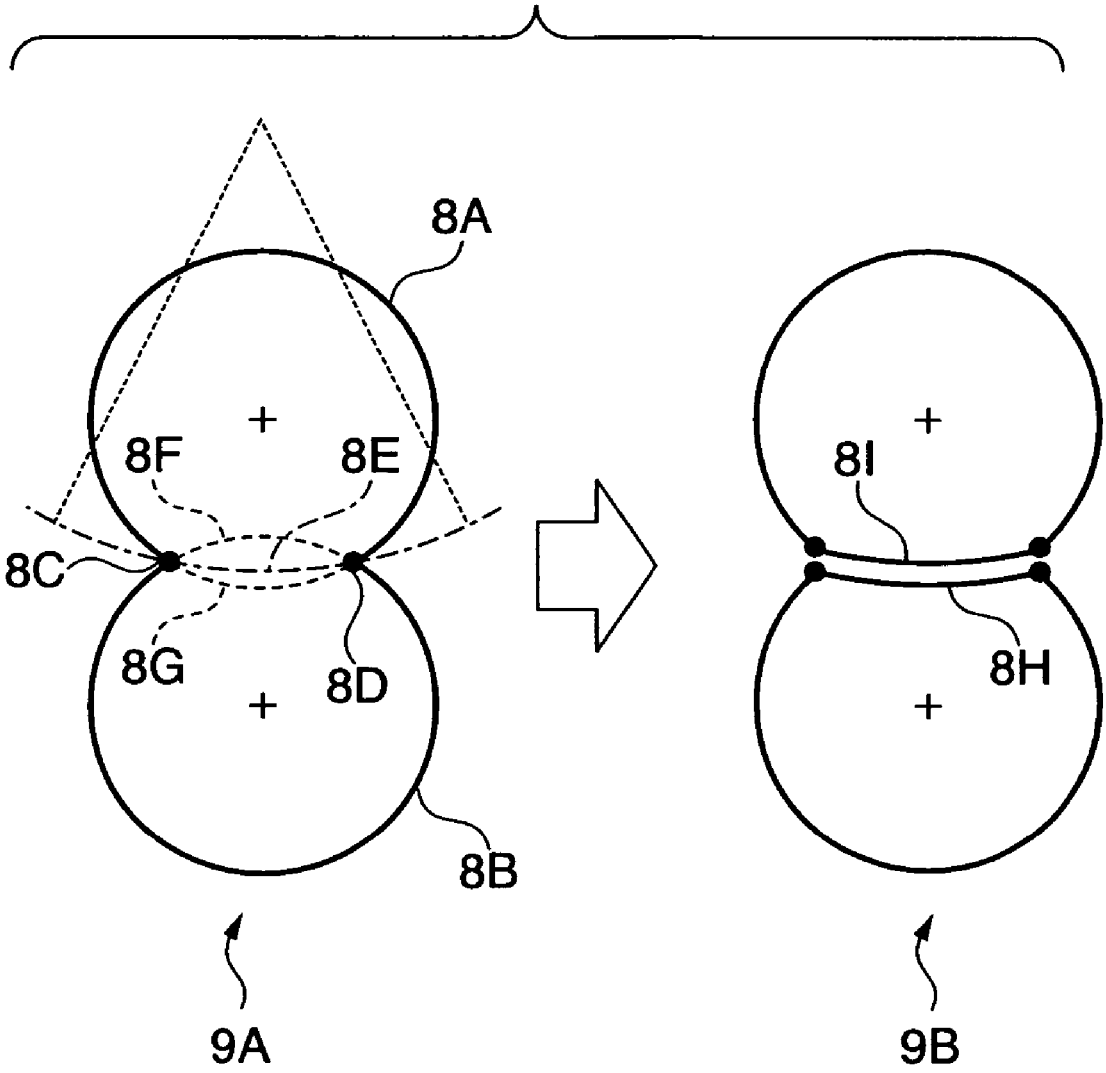
FIG. 9 is a view for explaining formation of another nip shape of the convey roller pair (when neither rollers are complete rigid bodies)

An example of the setting sequence of a nip shape of another convey roller pair will be explained below. An example of the arrangement different from that explained using FIGS. 5 to 7 (when one roller of the convey roller pair can be completely considered as a rigid body), i.e., an example in which both the rollers of the convey roller pair deform to form a nip will be explained. In the description of FIGS. 8 and 9, a repetitive description of FIGS. 5 to 7 will be avoided, and only differences will be explained. FIG. 8 shows a state wherein the convey roller pair setting window 7 is opened by double-clicking the convey roller pair after the convey roller pair are temporarily set on the graphic area 3 in the same manner as in the setting sequence used when one roller is a rigid roller.

The same processes for setting the centers and radii of respective rollers, selecting the rigid roller, and setting the center distance on the convey roller pair setting window 7 in FIG. 8 are the same as those in the sequence described using the setting window 5 in FIG. 6. Next, the user checks a button 7A to be able to set the radius of curvature of the nip. The user inputs the value of that radius of curvature to a field 7B. If the user agrees with the settings, he or she clicks an "OK" button 7D; if the user wants to cancel, he or she clicks a "cancel" button 7C. In this case as well, nip shape formation forms the nip shape of the convey roller pair using the radius of curvature of the nip which is input in accordance with the set rigidity ratio value of the convey roller pair and is used in generation of the nip shape. Of course, by further having setting means for setting the rigidity ratio of the roller pair, the covey roller pair to be designed can be changed to that having a rigidity difference.

Figure 26:
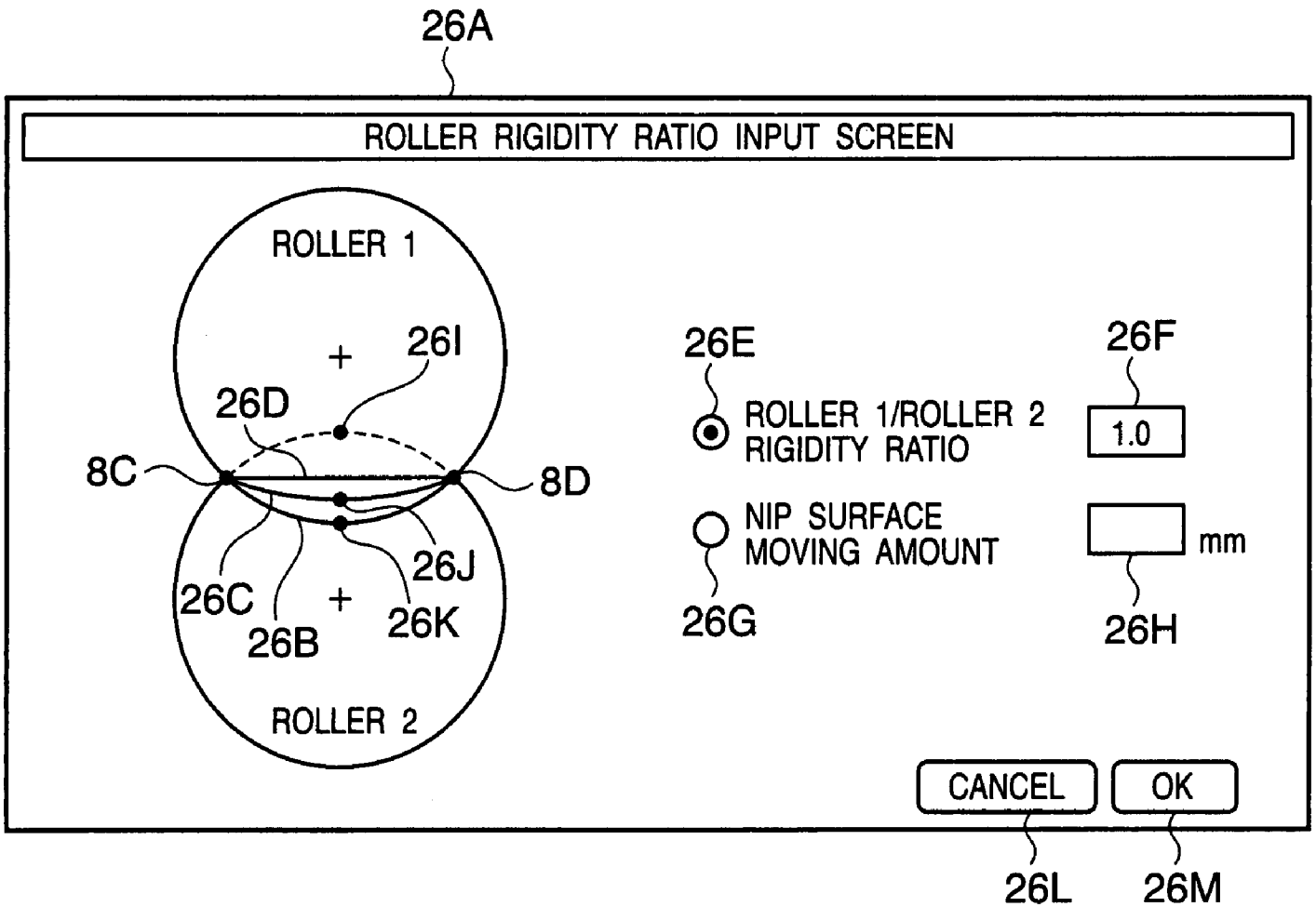
FIG. 26 is a view for explaining settings based on the calculation of the radius of curvature of the nip.

[Setting of Radius of Curvature of Nip by Calculation: FIG. 26]

In the present invention, by selecting a rigidity ratio input button 7F in FIG. 8 in place of inputting the value of the radius of curvature of the nip in FIG. 8, a rigidity ratio input screen shown in FIG. 26 may appear to calculate the radius of curvature. By selecting one of radio buttons 26E and 26G in FIG. 26, the radius of curvature of the nip shape can be determined. When the button 26E is selected, the user inputs the rigidity ratio between two rollers in an input field 26F. As for an amount deformed by the pressure between rollers, when roller 1 does not deform and roller 2 alone deforms, a nip shape is defined by an arc 26B. The state of the arc 26B is defined as a maximum value of the rigidity ratio, and the rigidity ratio=10 is defined in this embodiment. When rollers 1 and 2 have the same shapes and materials, a nip shape is defined by a line 26D. This state is defined as a minimum value of the rigidity ratio, and the rigidity ratio=1 is defined in this embodiment. In this embodiment, a case has been exemplified wherein the deformation amount of roller 2 is larger than that of roller 1, but their relationship may be reversed. Also, when a nip shape is defined by an arc 26C, the rigidity ratio=5 is set. When the button 26G is selected, a nip shape is specified by inputting, in an input field 26H, a moving amount due to deformation from a nip center corresponding position 26I before deformation. For example, when the nip shape is defined by the arc 26C, the moving amount to be input corresponds to the distance between points 26I and 26J. Upon selection of a button 26M, an arc that expresses the nip shape is specified, the radius of curvature is calculated as an arc that connects three points 8C, 8D, and 26J, and the calculated value is returned to a field 7B on the window 7 in FIG. 8. Upon selection of a button 26L, the setting of the radius of curvature of the nip shape based on the rigidity ratio is canceled, and the control can return to the window 7 in FIG. 8.

That is, in the present invention, the shapes of the rollers can be specified in accordance with the rigidity ratio. For example, when the rigidity ratio falls within a desired range, the surface shape of one roller may be corrected in correspondence with the curvature corresponding to that ratio. In this case, not only one roller is changed in correspondence with the curvature, but also the curvature may be changed at a predetermined magnification. In this case, a plurality of thresholds may be prepared in correspondence with rigidity ratios, and desired magnifications may be set for different ranges defined by the thresholds. In this case, the rigidity value ranges and the magnifications of the curvature (equal magnification if the same curvature is set) are stored in a database, and the roller can be corrected to a desired shape with reference to the database in accordance with input data.

Figure 23:
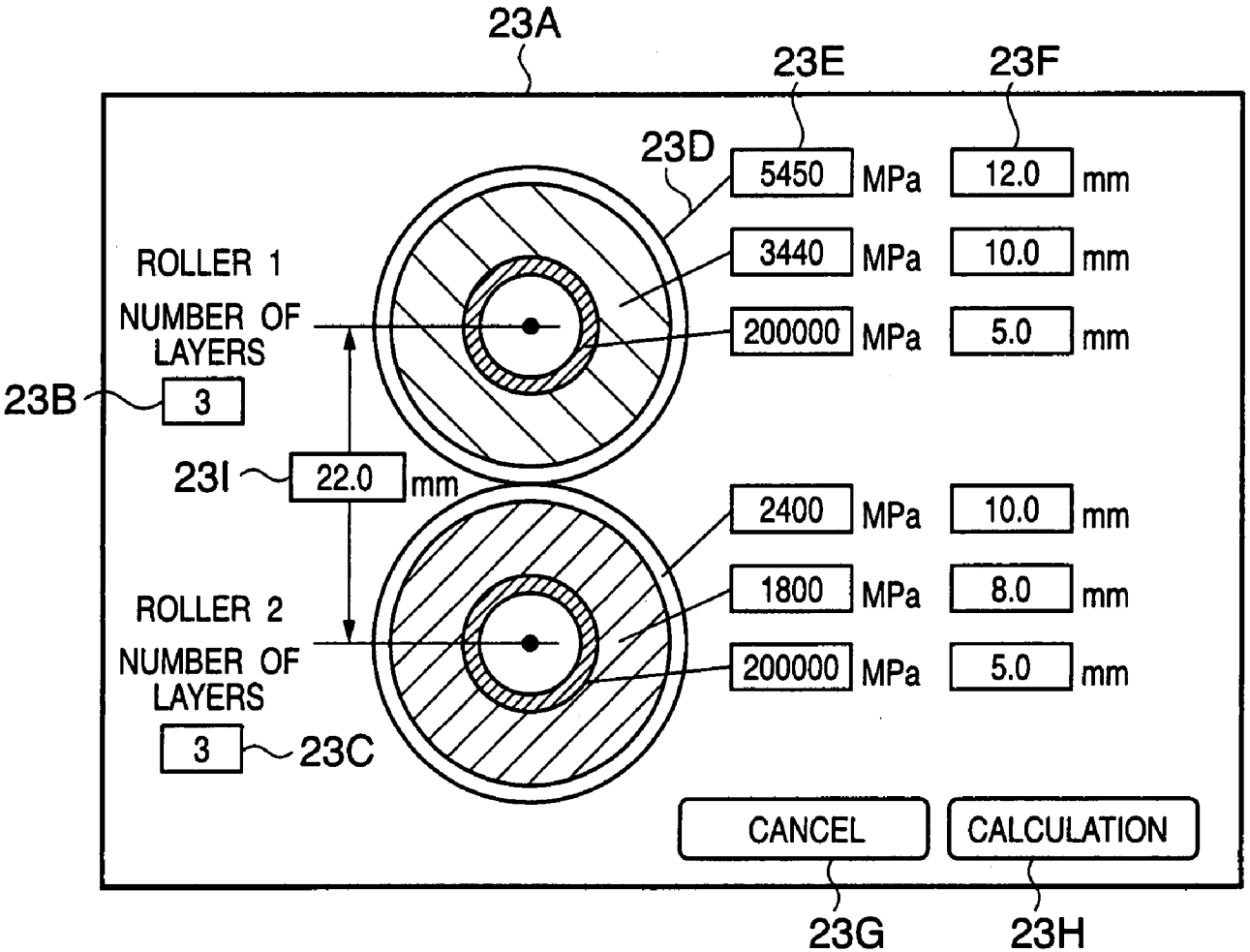
FIG. 23 shows an example of an input screen used to calculate a nip shape.

[Setting of Radius of Curvature of Nip by Finite Element Method: FIG. 23]

Figure 24:
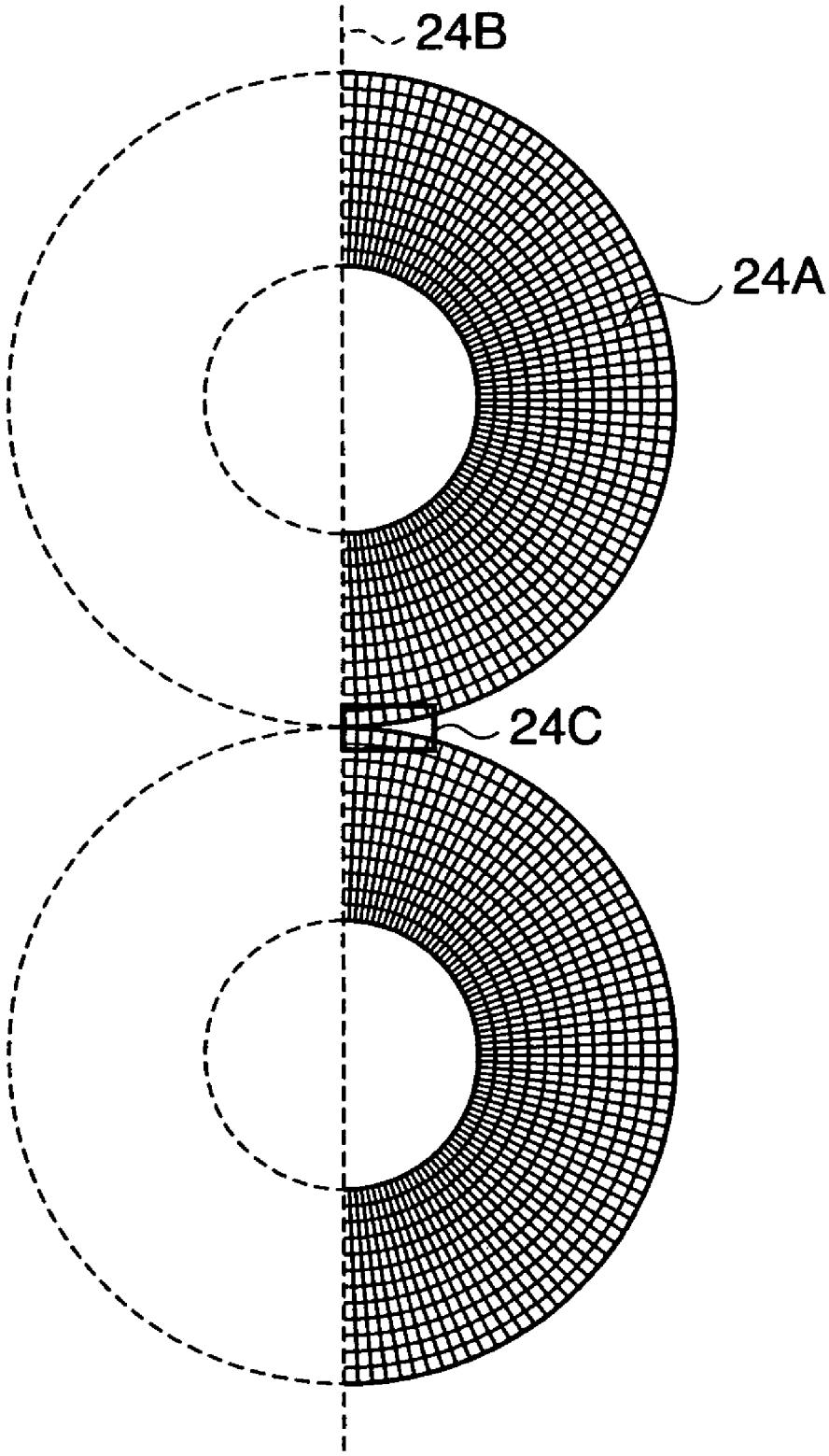
FIG. 24 shows an example of finite element method models used to calculate the nip shape.
Figure 25:
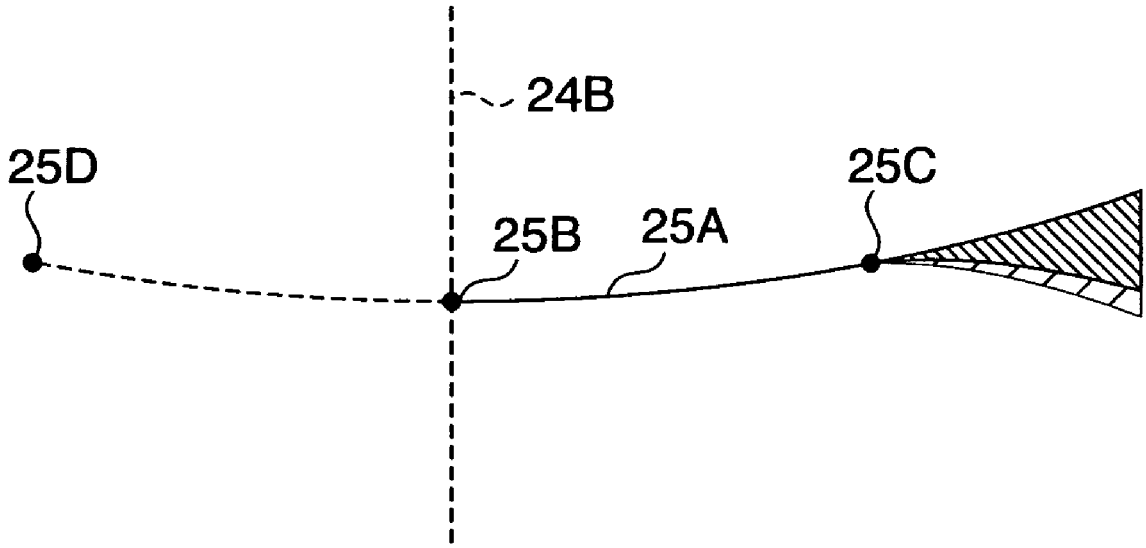
FIG. 25 is a view for explaining a method of calculating the radius of curvature of a nip on the basis of the calculation result of the finite element method.

The present invention further has means for, when the radius of curvature of a nip cannot be determined, obtaining the radius of curvature by structural analysis using the finite element method. When the user selects a button 7E shown in FIG. 8, a nip shape calculation window 23A shown in FIG. 23 opens. The user inputs the numbers of layers which form rollers 1 and 2 to input fields 23B and 23C, respectively. At this time, graphic images that represent the roller pair are drawn in the window 23A, and callouts 23D are also drawn for respective layers. Each input field 23E is used to input the Young's modulus of a material that forms each layer, and each input field 23F is used to input the outer dimension of each layer. An input field 23I indicates the center distance, and the value input on the window 7 in FIG. 8 can be directly referred to. Upon depression of a button 23G, a nip calculation can be canceled and the control can return to the window 7. Upon depression of a button 23H, a nip shape calculation starts by the finite element method based on the information input on the nip shape calculation window 23A. FIG. 24 shows a finite element model of the roller pair. Since the contact of the roller pair is apparently an axisymmetric problem with respect to a central line that connects the two roller axes, only one side with respect to a symmetric line 24B is selected as an object to be analyzed upon executing the nip calculation. Reference numeral 24A denotes a state wherein rollers are discretized as a manifold of finite elements. A nip is formed by the contact between the rollers, and FIG. 25 is an enlarged view of a portion 24C. Reference numeral 25A denotes an arc which is a nip shape calculated by the structural calculation based on the finite element method; 25B, a central position of the nip; and 25C, an end portion (nip end portion) where the two rollers contact. Reference numeral 25D denotes a position where the portion 25C becomes axisymmetric with respect to the symmetric line 24B. Finally, an arc that connects 25C, 25B, and 25D is calculated, and that value is returned to the field 7B on the window 7.

[Formation of Nip Shape of Convey Roller Pair (When Neither Rollers are Complete Rigid Bodies): FIG. 9]

The nip shape formation process will be described below. 9A of FIG. 9 shows an example of a roller pair and nip drawn based on the setting values on the window 7. In this example, a roller 8A corresponds to roller 1, and a roller 8B corresponds to roller 2. In the above settings, roller 1 is designated as a roller with a higher rigidity. A nip to be set currently appears at the designated curvature between arcs 8F and 8G cut by intersections 8C and 8D of the rollers 8A and 8B in place of a shape that abuts along one roller. Furthermore, in the current settings, since the roller 8A is the rigid roller, a nip has a convex shape toward the roller 8B side. An arc which has the radius of curvature designated in the field 7B on the window 7 and passes between 8A and 8B can be uniquely determined. 9A of FIG. 9 shows a one-dashed chain line 8E indicating the designated nip shape. Then, the arcs 8F and 8G are cut, and arcs each having a shape that abuts along the line 8E are formed on respective rollers like 8I and 8H of 9B of FIG. 9. A portion between 8H and 8I is defined as a nip where the flexible medium passes. Note that 9B of FIG. 9 illustrates 8I and 8H to be spaced apart, but they overlap on a single line in an actual model. As described above, in the arrangement in which one convey roller of the convey roller pair is not completely considered as a rigid body, when both the rollers deform to form a nip, and when a convey roller pair having a contact area is defined in the conveying path definition processing, the overlapping portion of the two rollers is cut. In the cut portion, arcs with the designated radius of curvature are formed on the respective rollers, and a portion between these arcs is defined as a nip, through which the flexible medium which is expressed as an elastic member by coupling a plurality of rigid elements having masses via springs can pass. Therefore, upon simulating the behavior of the flexible medium when both the rollers deform to form a nip, a nip on a model can be approximated to an actual nip. Hence, the behavior such as deformation, entry and exit angles, and the like of the flexible medium can be accurately calculated.

In the conveying path definition processing, since the aforementioned nip shape can be automatically set by inputting the radius of curvature of the nip portion, the operation of the design support apparatus 100 of this embodiment is facilitated and the number of design steps of the user can be reduced.

As described above, in the arrangement in which one convey roller of the convey roller pair is not completely considered as a rigid body, when both the rollers deform to form a nip, the nip shape is formed by the circumference 8I of roller 1 with a higher rigidity and the arc 8H of roller 2 with a lower rigidity, as shown in 9B of FIG. 9. This nip shape can approximate a nip shape on a model to an actual nip with higher accuracy than that of a convey roller pair which is defined by a straight line that connects 8C and 8D of 9A of FIG. 9 in the conventional design support apparatus. For this reason, using the nip shape set by the design support apparatus 100 of this embodiment, even a user (designer) who does not have expert knowledge on simulation pertaining to the modeling policy of a printing medium can analyze the behavior of a printing medium conveyed in a conveying path with relatively higher accuracy.

<2. Processing for Matching Feature Point of Drive Chart with Calculation Step>

In the description of 1), since a nip on a model is approximated to an actual nip in consideration of the rigidity ratio of the convey roller pair, the design support apparatus of this embodiment can analyze the behavior of a printing medium conveyed in a conveying path with relatively higher accuracy. Next, a point that the behavior of a printing medium conveyed in a conveying path can be analyzed with relatively higher accuracy using 2) a method of matching the feature point of the drive chart with the calculation step when the numerical calculation for solving the motion of a flexible medium is done using the drive chart will be explained. Note that the feature point of the drive chart includes the drive start and end times of the convey rollers or the change point of the drive velocity.

Figure 10:
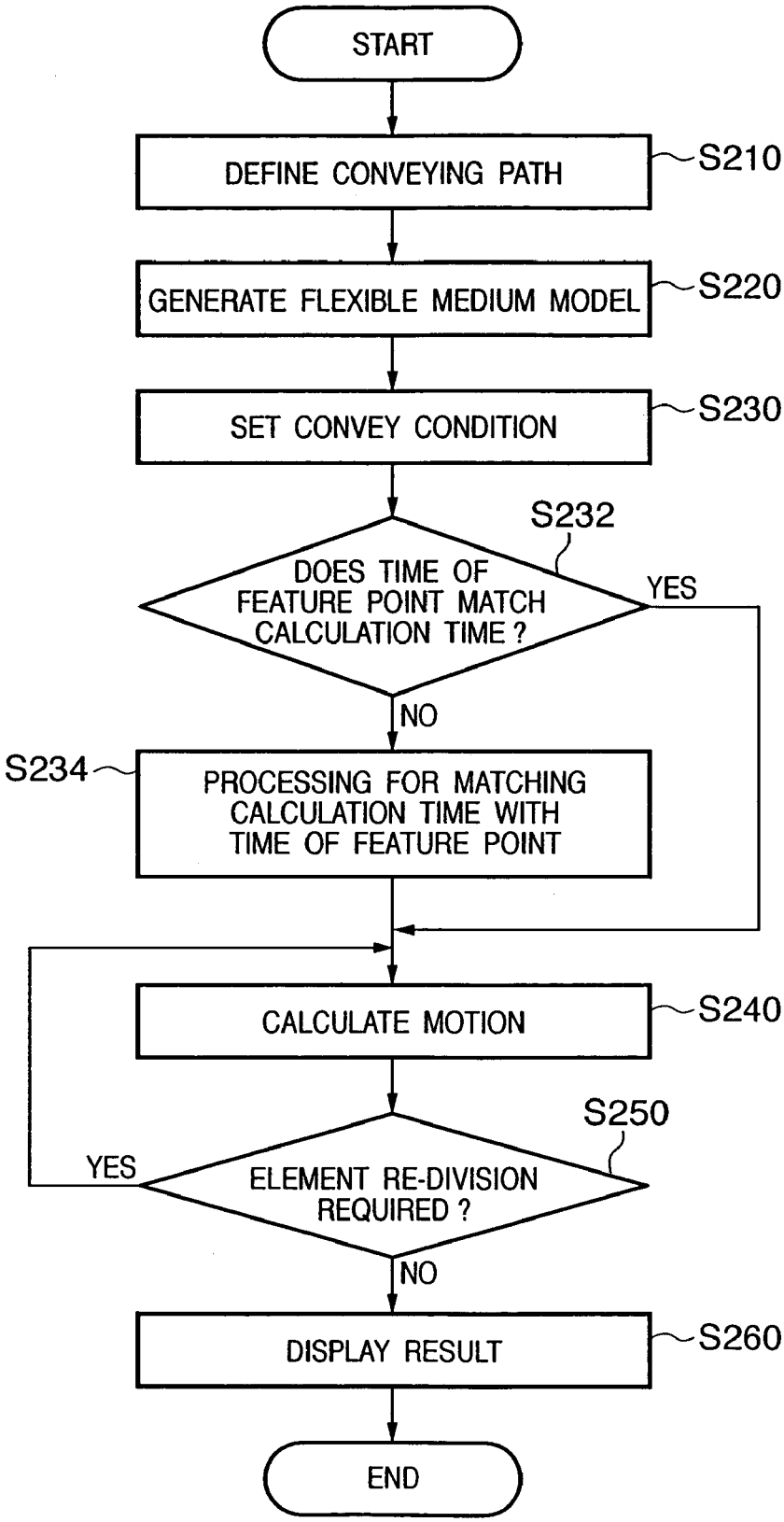
FIG. 10 is a flowchart showing the processing for accurately simulating the behavior of a flexible medium conveyed in a conveying path by matching a feature point of a drive chart in the design support apparatus of the present invention is matched with a calculation step.

[Processing of Design Support Apparatus: FIG. 10]

An example of the flow of processing for implementing an accurate simulation by matching the feature point of the drive chart with the calculation step upon analyzing the behavior of a flexible medium conveyed in a conveying path by a computer simulation in the design support apparatus 100 of this embodiment will be explained below using the flowchart of FIG. 10. The design support processing shown in FIG. 10 is executed by the CPU 110 while controlling respective units on the basis of the control program stored in the ROM 140.

Since the processes in steps S210 to S230 and S240 to S260 are as described above, a description thereof will be omitted.

If it is determined in step S232 as a characteristic feature of this processing that the time of the feature point (the time of a point when the drive velocity changes in the drive conditions) does not match a calculation time, the flow advances to step S234. In step S234, the calculation time is time-divided to match the calculation time with the time of the feature point, and the flow advances to step S240. On the other hand, if it is determined in step S232 that the time of the feature point matches with the calculation time, the flow jumps to step S240 without any processing. Therefore, if the time to be analyzed by the computer simulation matches the time of the feature point, and no problem upon time division is posed, a series of processes to be described below need not be executed. The processing executed when the time of the feature point does not match the calculation time will be described below.

Figure 11:
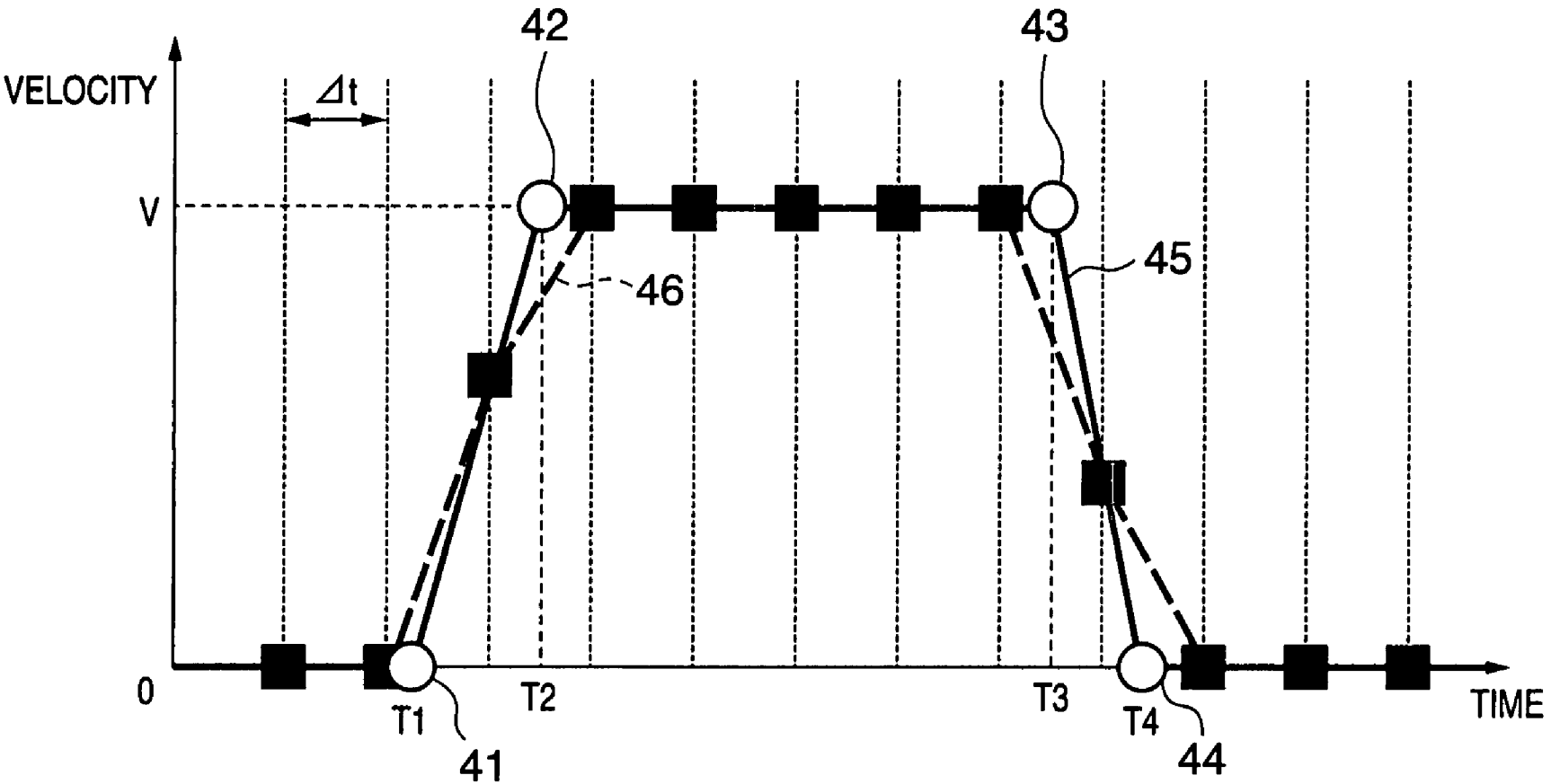
FIG. 11 is a view for explaining an example of a drive chart.

[Processing when Time of Feature Point of Drive Chart Does not Match Calculation Time (Step S232): FIG. 11]

Processing for solving a problem of analysis accuracy drop when the time of the feature point of the drive chart does not match the calculation time upon analyzing the behavior of a printing medium conveyed in a conveying path by a computer simulation using the design support apparatus 100 will be described below. In the processing to be described below, an explanation along a processing example in the motion calculation processing in the drive chart shown in FIG. 11 will be given. FIG. 11 shows an example of the drive chart of the convey rollers. The abscissa plots time, and the ordinate plots the velocity. This chart represents that the convey rollers begin to drive at time T1, are linearly accelerated to reach velocity V at time T2, are constantly driven at V until time T3, and are linearly decelerated to velocity 0 from time T3 to time T4.

An example of this chart is given by an origin 0, feature points 41 (convey roller drive start time), 42 (convey roller constant speech reach time), 43 (convey roller deceleration start time), and 44 (convey roller drive stop time). The values between the neighboring feature points 41, 42, 43, and 44 are linearly interpolated, and correspond to a chart 45 expressed by the solid line. Assume that a calculation time step Δt is given by an interval shown in FIG. 11. Then, velocity values calculated at respective calculation steps are those at square points on FIG. 11. However, when these points are linearly interpolated, a dotted line 46 is obtained. Since respective feature points deviate from respective times of calculation time steps Δt, they deviate from the set chart 45. In this case, if the calculations advance under the condition of the dotted line 46, the accuracy of the obtained analysis result drops.

Figure 12:
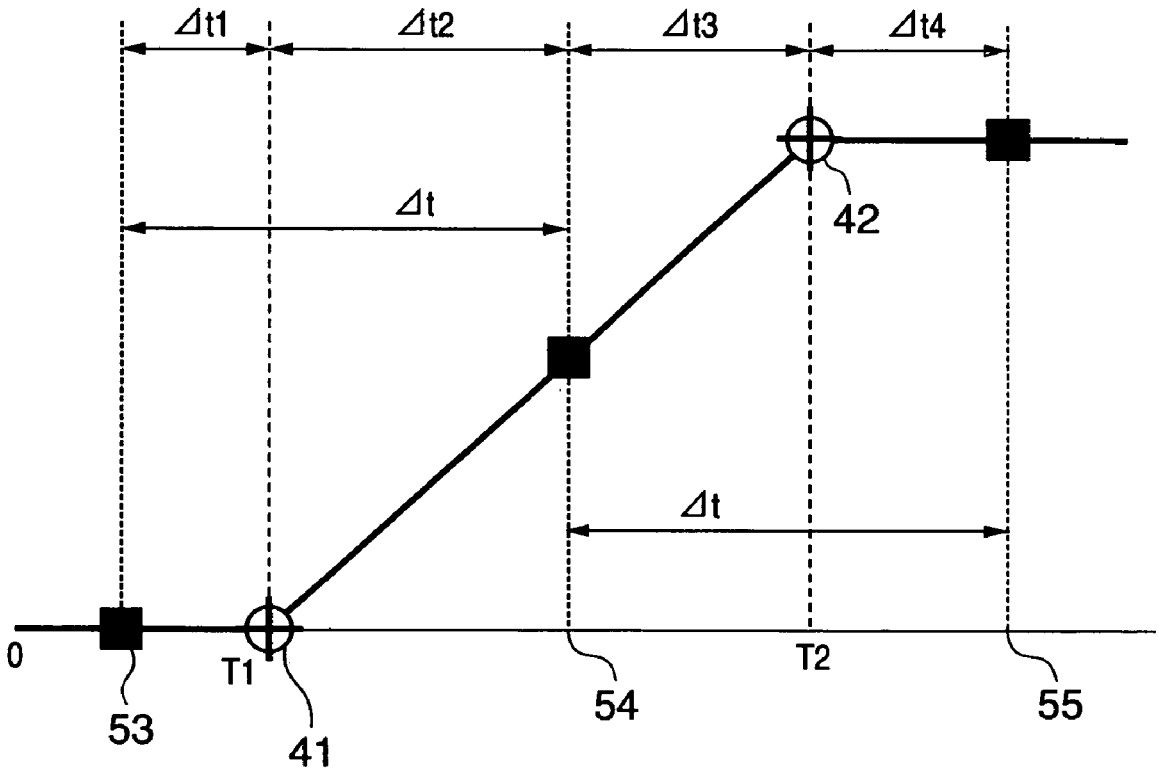
FIG. 12 is a partially enlarged view of the drive chart shown in FIG. 11.

[Method of Matching Time of Feature Point with Calculation Time (Step S234): FIG. 12]

Hence, in this embodiment, in order to eliminate this deviation and to make a calculation under the drive conditions along the chart, the calculation steps are adjusted in the following sequence. FIG. 12 is an explanatory view obtained by enlarging the neighborhood of the feature points 41 and 42 in FIG. 11.

If the chart and calculation time step Δt are set as calculation conditions, it is checked if the times of the feature points match the calculation times at calculation time steps Δt. FIG. 12 shows an example of a chart which requires adjustment. This chart has the feature points 41 (time T1) and 42 (time T2). When the calculations advance at time divisions of the calculation time step Δt, calculation times 53, 54, and 55 appear in turn, and do not match times T1 and T2. For example, in the decision at the feature point 41, T1/Δt is calculated, and it is checked if T1/Δt is divisible (or if it is determined that a faction is sufficiently small). The same applies to the feature point 42. If T1/Δt is indivisible, the calculation time step Δt is divided into calculation time steps Δt1, Δt2, Δt3, and Δt4. The calculation time step Δt1 assumes a value obtained by subtracting a time 53 from the time T1, and the calculation time step Δt2 is calculated by subtracting the calculation time step Δt1 calculated now from the calculation time step Δt. The same applies to the calculation time steps Δt3 and Δt4. With this division, in a period in which calculations are made in two steps by the time division of the calculation time step Δt, calculations are made in four steps by this division.

Figure 13:
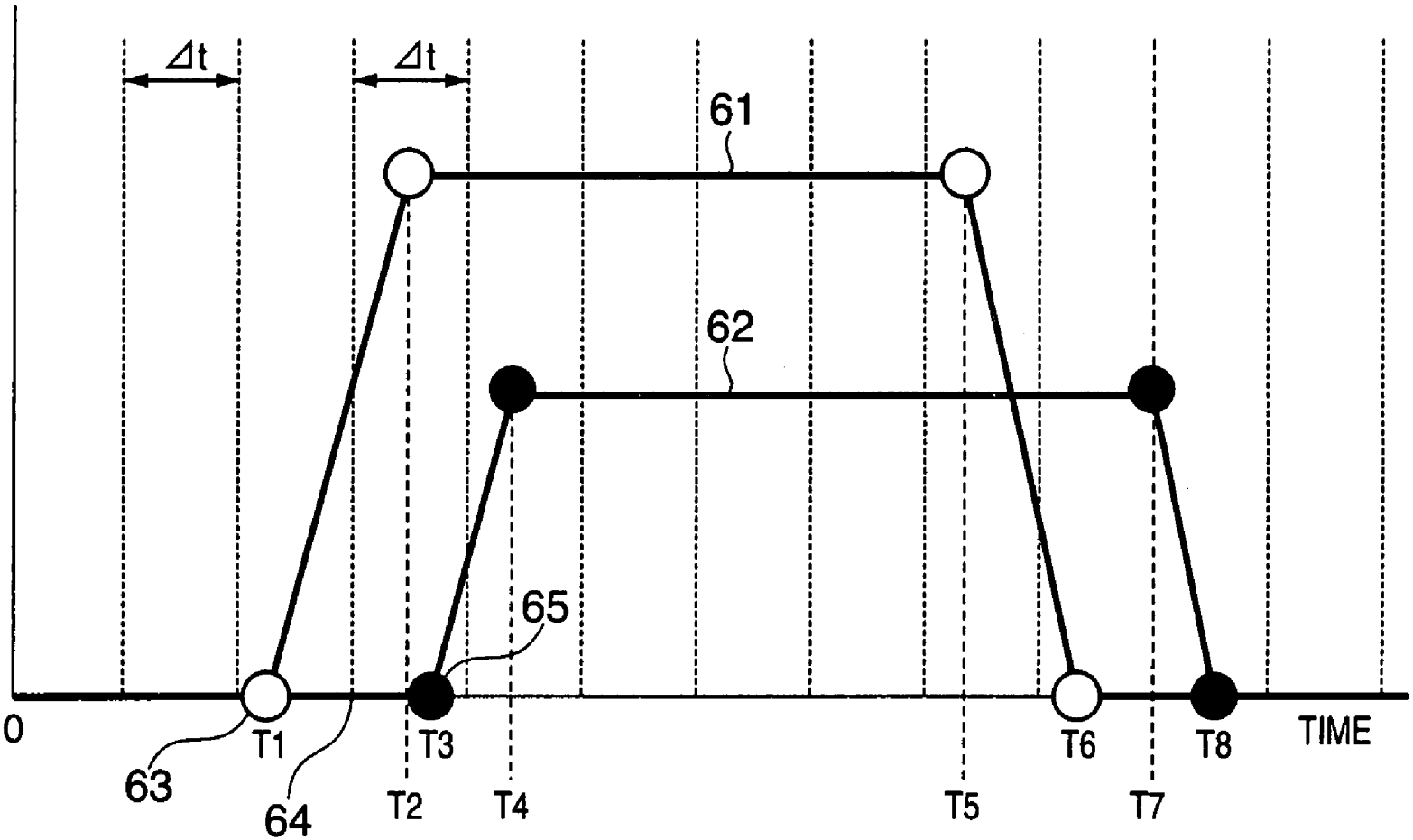
FIG. 13 is a view for explaining another example of a drive chart.

[Processing when there are a Plurality of Drive Conditions: FIG. 13]

When there are a plurality of drive conditions and a plurality of charts are set, feature points are extracted from all these charts. FIG. 13 shows an example of two charts 61 and 62 for the sake of simplicity. In case of this example, feature points are respectively extracted at eight times T1 to T8. Next, the value of each feature point is divided by the calculation time step Δt to check if it is divisible. In this example, since the time T7 is located at a just divisible position, this point does not require adjustment of the calculation time step Δt. If the value of the feature point is indivisible, the calculation time step Δt is adjusted so that the calculation step is located at that time as in the example of FIG. 12. In the example of the time T1, the calculation time step Δt is divided into a total of two steps, i.e., one step from a time 63 to the time T1 and one step from the time T1 to a time 64. For the times T4, T5, T6, and T8, the calculation time step Δt is similarly divided. On the other hand, two times, i.e., the times T2 and T3 are included in the default calculation time step Δt. In this case as well, the calculation time step Δt is divided into three steps, i.e., one step from a time 64 to the time T2, one step from the time T2 to the time T3, and one step from the time T3 to a time 65, so that the calculation steps is located at these times. Even when the calculation time step Δt includes three or more feature points, it is similarly divided at the times of these feature points. In this manner, time divisions that match feature points are determined in advance, and calculations are made along these time divisions.

As described above, according to this embodiment, calculations can be made under the accurate drive conditions by discretizing the times upon solving the motion of equation. That is, the time division values are adjusted to locate the times at the feature points, so that feature points (the drive start and end times, the velocity change time, and the like) of the drive chart used to control building parts such as convey rollers and the like in the conveying path match the times. For this reason, the actual drive conditions can be correctly expressed. In the aforementioned motion calculation processing, since the time division values are automatically adjusted, even a designer who does not have expert knowledge on simulation can derive an accurate calculation result without making any troublesome result verifications.

Figure 14:
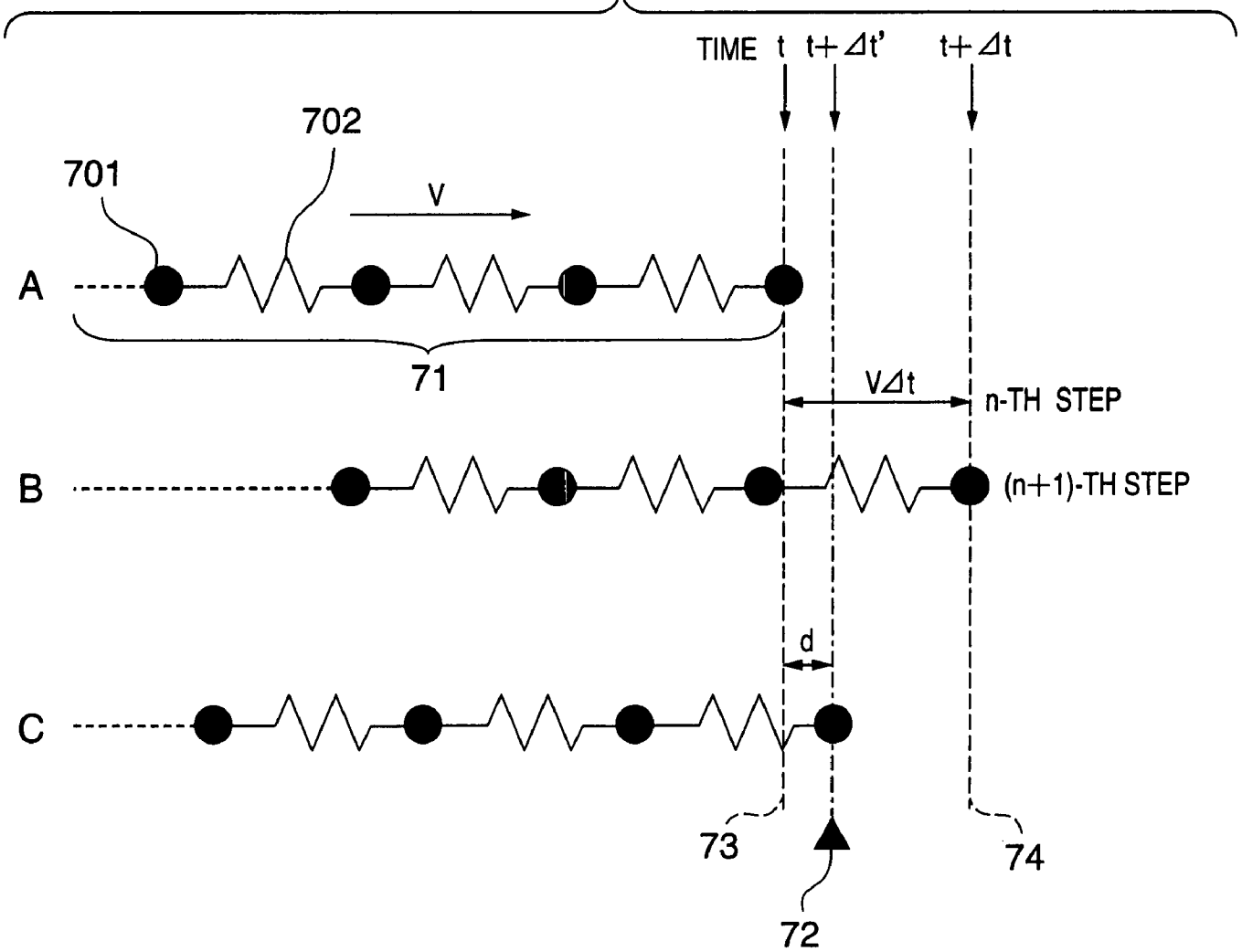
FIG. 14 is an explanatory view of detection of the flexible medium leading end, in which A indicates the n-th step position of the flexible medium, B indicates the (n+1)-th step position of the flexible medium (before time division adjustment), and C indicates the (n+1)-th step position of the flexible medium (after time division adjustment)
Figure 15:
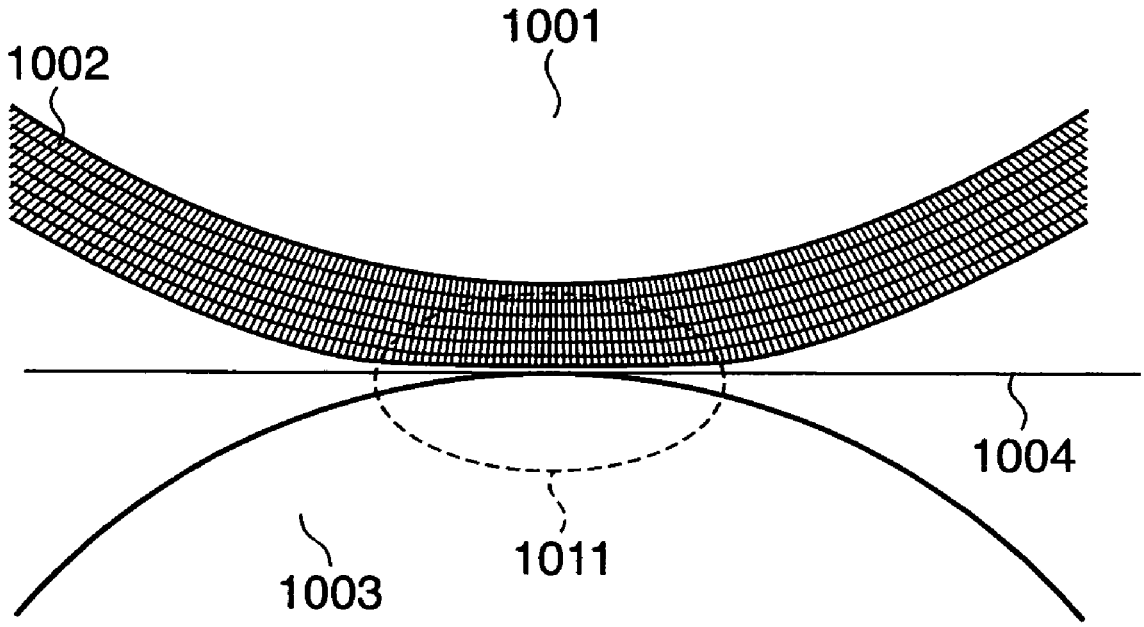
FIG. 15 is a view for explaining a deformation state in a nip of rollers.
Figure 16:
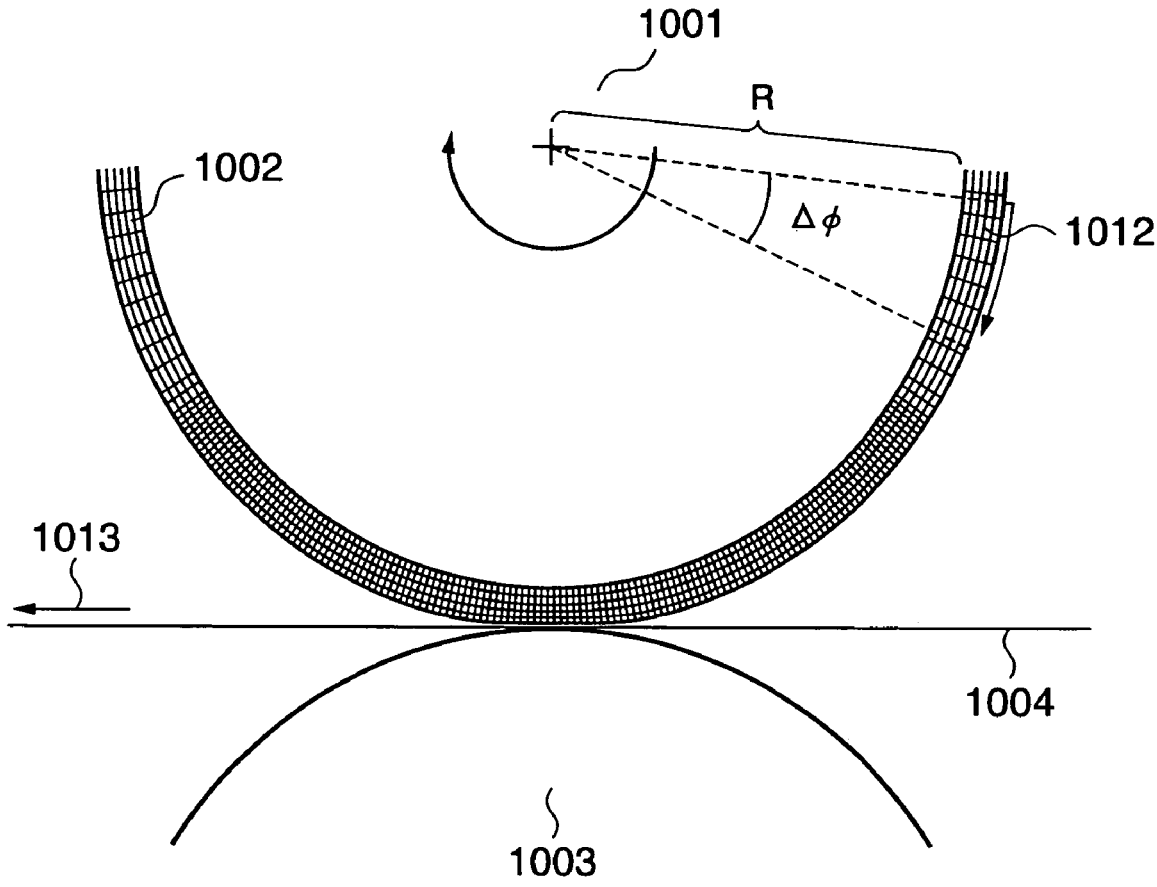
FIG. 16 is a view for explaining velocity variations caused by deformation in the nip of the rollers.

[Processing when Leading End Position of Flexible Medium does not Match Change position of Drive Condition: FIG. 14]

Another processing for improving the analysis accuracy when the behavior of a printing medium conveyed in a conveying path by a computer simulation will be described below. More specifically, the processing for solving a problem of analysis accuracy drop when the leading end position of a flexible medium does not match the detection position of a sensor where the drive condition is to be changed upon changing the drive conditions will be explained. Note that the following processing is basically processed according to that in the motion calculation in FIG. 2.

A case will be examined wherein a drive condition changes at the instance when the conveyed flexible medium passes a given detection position to have its leading end as an object to be detected as an example in which drive starts under an arbitrary condition during calculations. FIG. 14 shows an example of this state. Reference numeral 71 denotes a flexible medium which is conveyed at a velocity V in the direction of an arrow in FIG. 14. Reference numeral 72 denotes a detection position of a sensor which changes an arbitrary drive condition by detecting the leading end of the flexible medium. The flexible medium is expressed by mass points 701 and springs 702 which connect them. Assume that a state wherein the calculation in a given calculation step (to be referred to as an n-th step hereinafter for the sake of simplicity) is complete corresponds to state A. In this state, the leading end of the flexible medium is located at a position 73 (the leading end position of the flexible medium in the n-th step) and does not reach the detection position 72 yet. If a state Δt ahead of this state is calculated as the (n+1)-th step, the flexible medium moves along VΔt in the direction of the arrow and has state B. In this state, the leading end of the flexible medium has passed over the detection position 72. Assuming that detection is made at that time, the drive condition is changed, and when a calculation in the next (n+2)-th step starts, the calculation the drive condition of which has been changed at a timing behind the initially input condition is made. In this case, if the calculations advance under the conditions of B the analysis result accuracy unwantedly drops.

Hence, in the design support apparatus 100 of this embodiment, when the detection position has passed over the detection position in the calculation in the (n+1)-th step, the control returns to the position 73 as the end timing of the n-th step again. In order to form a step at which the leading end of the flexible medium matches the detection position 72 from this step like C, the calculation time step Δt is divided into steps Δt' and Δt" by:

$$\Delta t' = d/V$$

$$\Delta t'' = \Delta t - \Delta t'$$

By making calculations in this way, a calculation is made in the calculation time step Δt' up to the sensor detection position 72 under the condition in which no leading end is detected, and calculation is made in the calculation time step Δt" up to a position 74 (the leading end position of the flexible medium in the (n+1)-th step) under a condition after detection. For this reason, calculations can be made under accurate calculation conditions.

In practice, a mechanism to be detected may be taken into consideration in addition to the leading end of the flexible medium. In any case, when the instance of detection deviates from the time of the calculation step, such problem can be solved by adjusting the time division by the same method.

As a calculation sequence, before the beginning of calculations along calculation time steps Δt determined in advance, a feature point for which the time division must be adjusted like the aforementioned detection position 72 of the flexible is selected. Then, the distance between the detection position and the object to be detected and whether or not the object to be detected has passed the detection position are checked for each calculation step. If a situation that the object to be detected has passed over the detection position in a given calculation step occurs, the control returns to an initial state of the step calculated now. Then, the time division is made, i.e., the calculation time step Δt is divided into calculation time steps Δt' and Δt" so that the object to be detected matches the detection position, and the calculation is redone. In the next step, the initially determined calculation step Δt is returned to continue a calculation.

When there are a plurality of detection positions in a calculation model, and respective objects to be detected simultaneously pass over their detection positions in a given calculation step, the smallest one of calculation time steps Δt' calculated at the respective detection positions is adopted to make a calculation. In the calculation of the next calculation time step Δt", another detection position is checked again, and the calculation time step undergoes further time division in case of detection. In this manner, calculations are made so that drive conditions depending on every detection positions are accurately expressed.

As described above, in this embodiment, in the aforementioned motion calculation processing, when the drive conditions for controlling building parts such as convey rollers and the like in a conveying path are determined by conditions such as the position of a flexible medium in calculations, the following processing can be made. That is, a time division value is automatically adjusted while monitoring the state of a feature point so as to locate the time at the feature point, so that the time matches the feature point of the drive chart that controls building parts such as convey rollers and the like in a conveying path. For this reason, actual drive conditions can be correctly expressed for those which change in calculation processes, thus deriving an accurate calculation result.

<3. Processing for Reflecting Velocity Variations Upon Deformation of Convey Roller Pair>

A method of reflecting velocity variations upon deformation of the convey roller pair arranged in a convey unit will be described below. The following description uses an example of calculating a variation value, i.e., a velocity variation rate by contact structural analysis based on a finite element model. However, this variation rate may be calculated based on a simplified roller shape.

Figure 17:
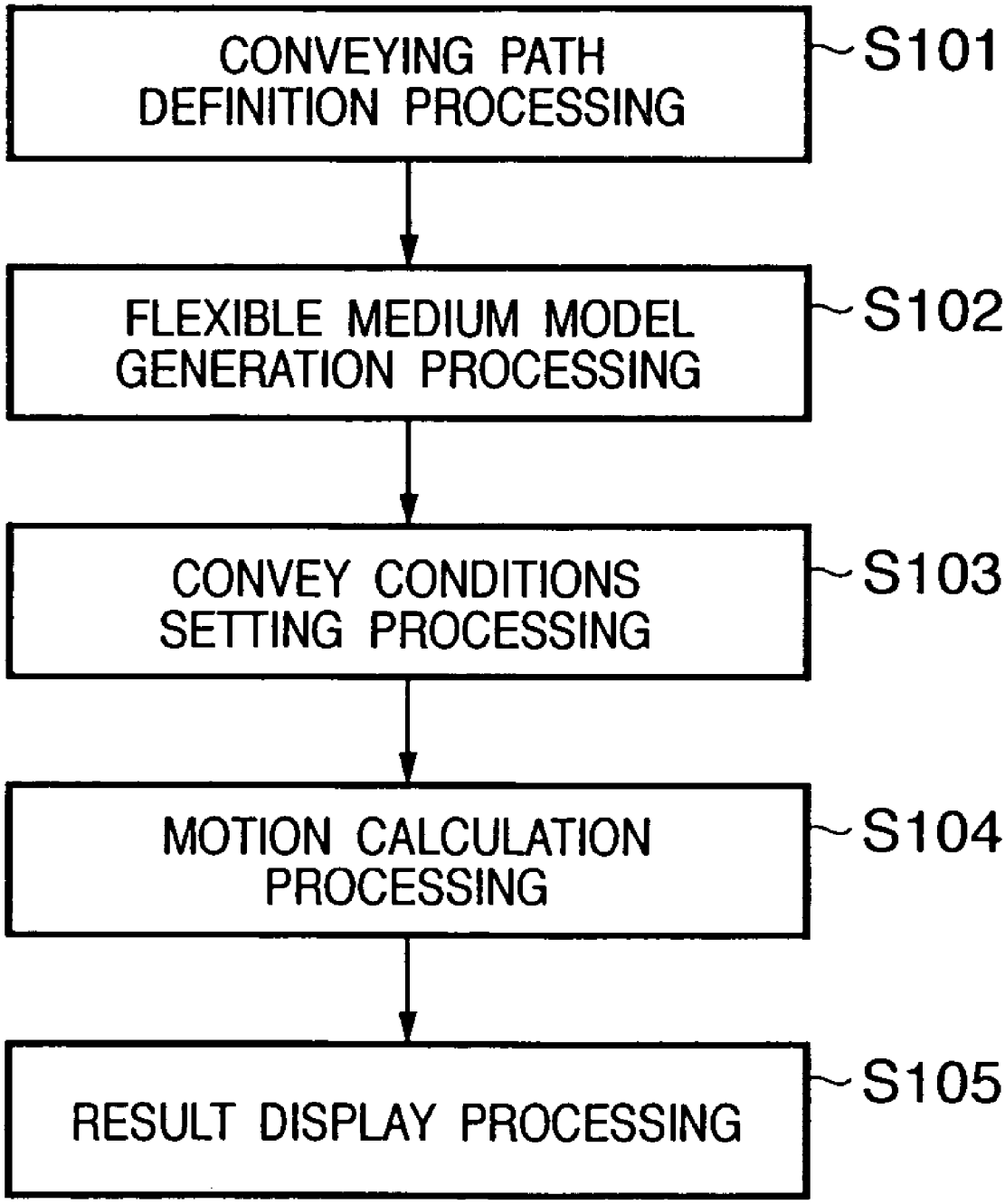
FIG. 17 is a flowchart showing the processing for accurately simulating the behavior of a flexible medium conveyed in a conveying path by reflecting velocity variations caused by deformation of the convey roller pair in the design support apparatus of the present invention.

[Processing of Design Support Apparatus: FIG. 17]

FIG. 17 is a flowchart for explaining only principal part of an example of the execution order of respective processes in the processing of the design support program in the design support apparatus 100 of this embodiment as one of information processing apparatuses. As shown in FIG. 17, this design support apparatus 100 executes conveying path definition processing for defining the positions and the like of convey rollers (step S101), flexible medium model generation processing (step S102), and convey conditions setting processing (step S103) first. Next, the design support apparatus 100 sequentially executes motion calculation processing for time-serially calculating the behavior of the flexible medium by a numerical simulation (step S104) and result display/output processing (step S105). The processing steps shown in FIG. 17 are the same as those described above.

Figure 18:
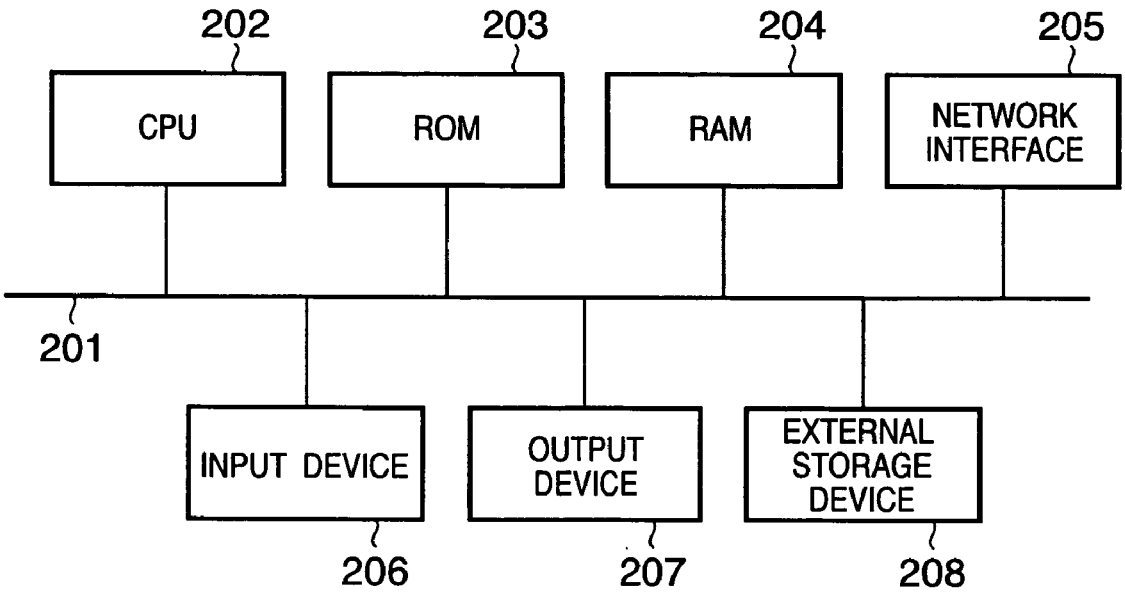
FIG. 18 is a block diagram showing another example of the arrangement of a design support apparatus of the present invention.

[Another Arrangement of Design Support Apparatus: FIG. 18]

FIG. 18 shows an example of another arrangement of the design support apparatus 100 of this embodiment.

In this example, a central processing unit (CPU) 202, ROM 203, RAM 204, network interface 205, input device 206, output device 207, and external storage device 208 are connected to a bus 201.

The CPU 202 performs processing or arithmetic operations of data, and controls various building parts elements connected via the bus 201. The ROM 203 and external storage device 208 store computer programs in advance, and the CPU 202 executes designated processing including the present invention on the basis of the computer program. These computer programs are read out onto the RAM 204, and are executed by the CPU 202. The RAM 204 is used as a work memory for input/output and transmission/reception of data, and a temporary storage for control of respective building elements. The external storage device 208 is a nonvolatile memory such as a hard disk storage device or the like. The input device 206 includes a keyboard, mouse, and the like, and the output device 207 includes a display device such as a liquid crystal display or the like. The network interface 205 exchanges data with an external terminal.

A prediction method of a velocity variation rate due to deformation of convey rollers based on respective parameters will be described below. More specifically, an example of a case wherein a velocity variation rate is calculated by contact structural analysis using a finite element model for a combination of many parameters, and a function that represents the relationship between the factor values and the obtained velocity variation rate will be explained below.

A method of generating a function using the contact structural analysis result will be explained first. As the method of generating a function, a generation method which performs curve fitting by the method of least squares using data points of contact structural analysis to which parameter combinations are distributed is generally used. However, in order to obtain a polynomial with higher accuracy, parameter combinations of contact analysis using a finite element model may be assigned to and selected from an orthogonal table in the experimental design, and a Chebyshev orthogonal polynomial may be used as the polynomial.

Figure 19:
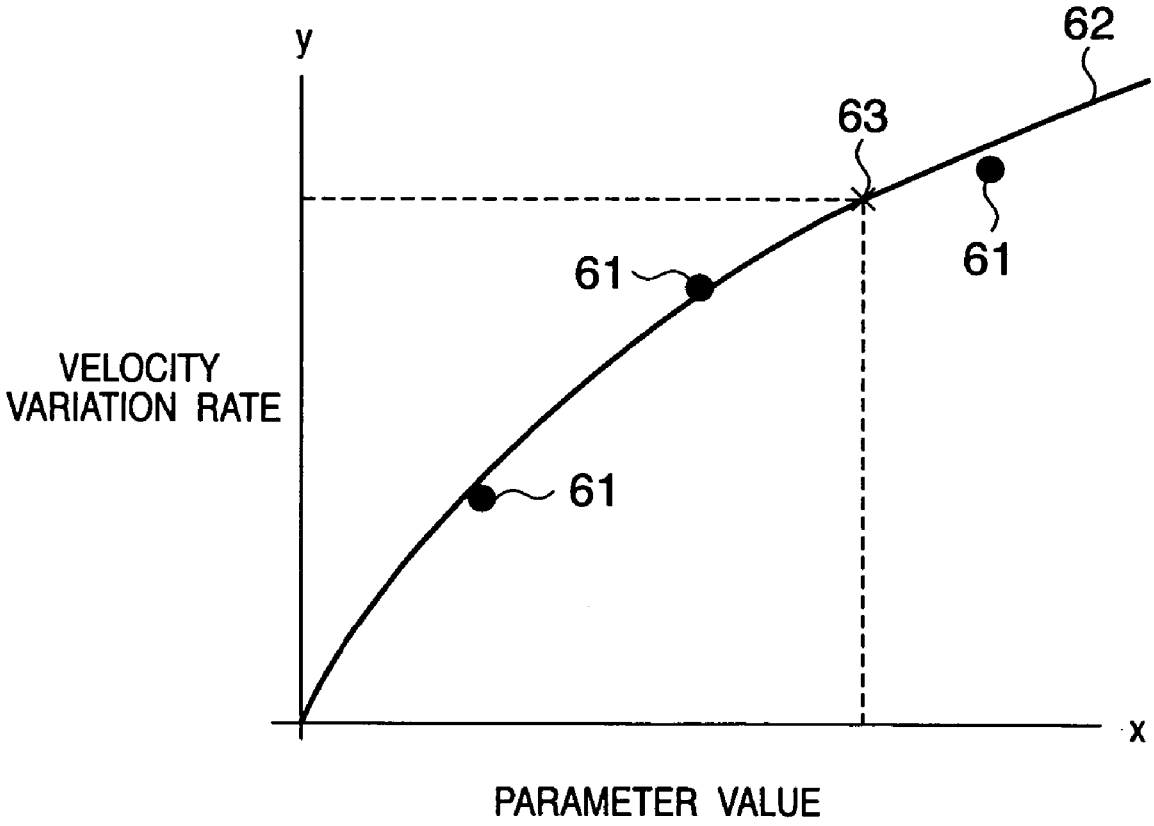
FIG. 19 is a graph showing an example of a function that indicates the relationship between the parameter value and velocity variation rate.

[Generation of Function: FIG. 19]

FIG. 19 shows an example of a function 62. FIG. 19 shows a linear graph for the sake of illustration, but the number of parameters becomes the number of dimensions in practice. The abscissa plots a parameter value, and the ordinate plots a velocity variation rate. Data points where velocity variation rates are calculated by contact structural analysis are indicated by data 61, and the function 62 of interpolating these points is generated. Using this function, even with an arbitrary parameter value that does not undergo contact structural analysis, a velocity variation rate can be estimated like an estimated point 63.

Figure 20:
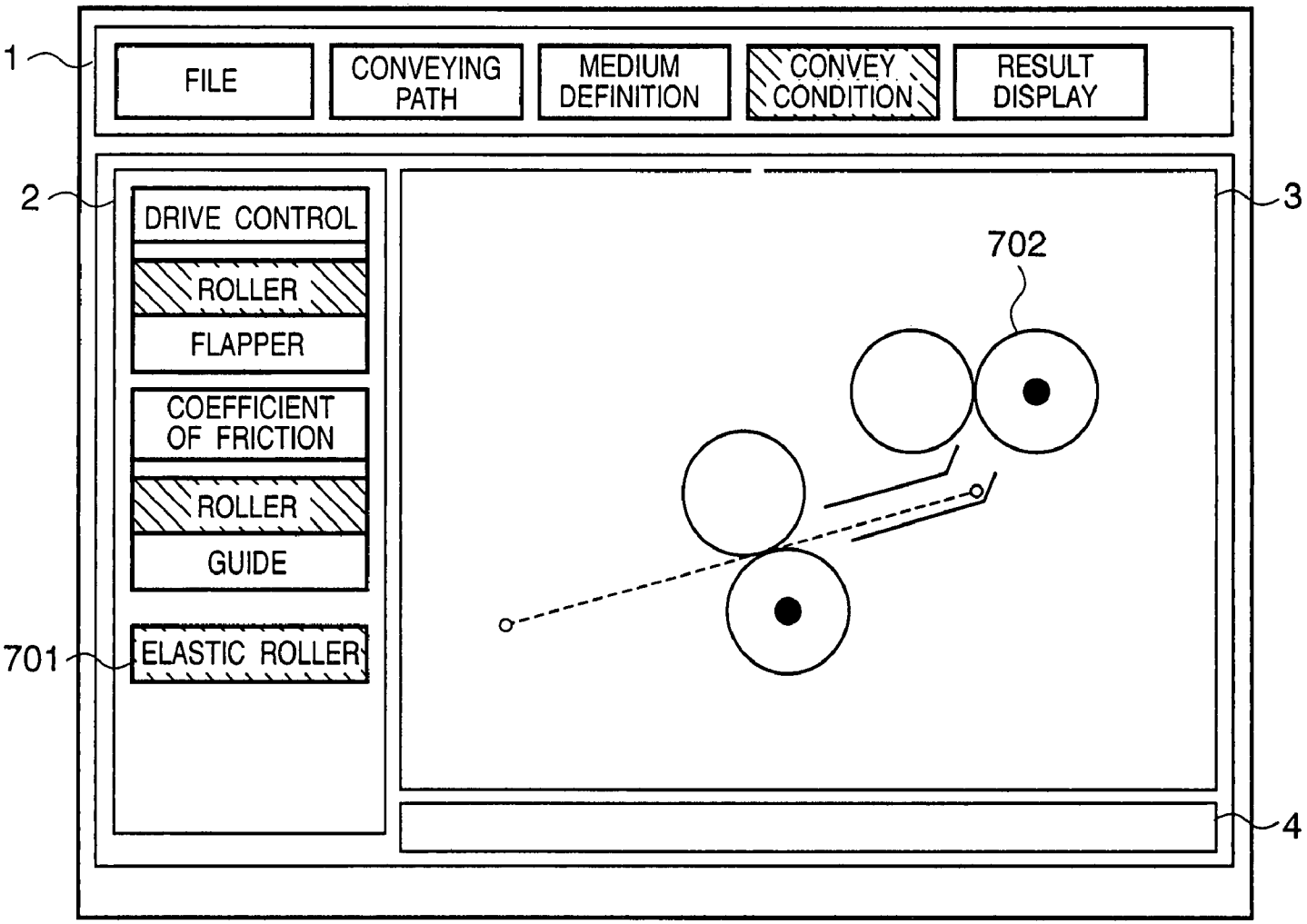
FIG. 20 shows an example of a convey condition setting screen used to define rollers.

[Convey Condition Setting Screen: FIG. 20]

FIG. 20 shows a display screen example of the apparatus which executes a simulation. An example of processes of the calculation processing of the velocity variation rate of velocity variations caused by deformation of the convey rollers will be explained using FIG. 20. Processes for defining elastic rollers will be explained below.

When the user selects the "convey condition" button in the menu bar 1, the apparatus detects it. Upon detection of this selection, the apparatus sends a signal to the display device to change the contents of the sub-component menu 2 to definition button display associated with the settings of the convey conditions as needed. When an "elastic roller" definition button 701 in the sub-component menu 2 is selected and its selection is detected, a desired elastic roller to be defined is selectable from convey rollers displayed within the graphic area 3 that displays the conveying path defined in advance. Assume that the user selects a roller 702.

[Parameter Input Screen: FIG. 21]

Upon detection of the selected roller, an input screen used to input parameters of the roller is displayed as a window, as shown in FIG. 21. In FIG. 21, the driving roller diameter and driven roller diameter of the convey roller pair, the thickness of a rubber layer, the thickness of a surface layer, and the rubber Young's modulus of the convey roller, and the like can be input as parameters. However, as parameter input items, if there are other parameters such as a material, hardness, pressure, and the like, which influence the velocity variation rate, all parameters including them are preferably taken into consideration. Of course, depending on the required simulation level, these parameter input items may be selected as needed, or only required parameters may be selected carefully.

The input screen shown in FIG. 21 shows a case wherein the driving roller, driven roller, pressure, rubber thickness, surface layer, and rubber Young's modulus are input. More specifically, as the driving roller (a roller which is practically driven by a motor or power transmitted from a motor or the like), a diameter=60 mm is input. Also, as the driven roller (a roller which is rotated upon rotation of the driving roller), a diameter=60 mm is input. Also, 100 kg as the pressure, 3 mm as the rubber thickness, 30 μm as the surface layer, and 1.5 Mpa as the rubber Young's modulus are respectively input. Upon completion of input of these numerical values, if selection of an "OK" button is detected, the parameter values are substituted in a function, and a calculation result 703 of the estimated velocity variation rate is displayed. In FIG. 21, a velocity variation rate=1.038 is displayed as the calculation result.

By exploiting this calculation result, if it is defined that the diameter of the selected is 20 mm and the rotational speed is 120 rpm, a nominal value of the convey velocity in consideration of the velocity variation rate can be calculated as 7,822 mm/min. That is, a nominal value of the convey velocity is calculated as 20×3.14×120=7,536 mm/min, but if the velocity variation rate is taken into consideration, it can be calculated as 7,536×1.038=7,822 mm/min.

Figure 22:
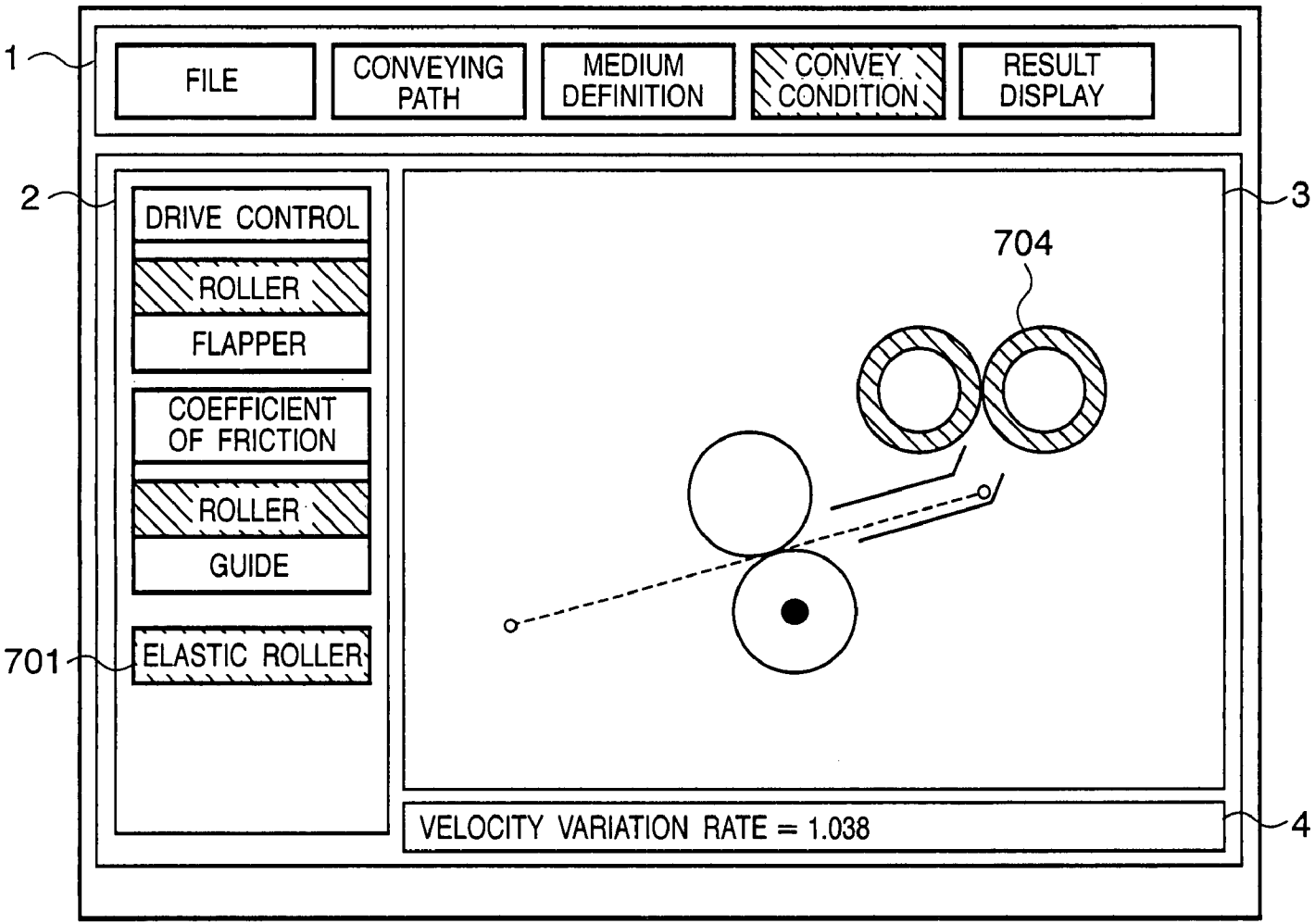
FIG. 22 shows an example of a display screen on which rollers that consider the velocity variation rate are defined.

[Convey Condition in Consideration of Velocity Variation Rate: FIG. 22]

For the selected roller, a convey velocity that takes the calculated velocity variation rate into consideration is defined. It is desirable to definitize the roller that takes the calculated velocity variation rate into consideration by changing its display method (e.g., using different colors) to be easily distinguished from other rollers like 704 in FIG. 22. In FIG. 22, the velocity variation rate is displayed in the command field 4 or in the vicinity of the roller.

In this manner, the convey conditions are re-defined in consideration of the velocity variation rate due to deformation of an elastic roller, and the behavior calculation of a flexible medium is done in the motion calculation sequence. Then, a behavior simulation such as a tension, slack, and the like produced on the flexible medium can be made with higher accuracy.

The present invention can be practiced in the forms of a system, apparatus, method, program, storage medium, and the like. More specifically, the present invention can also be achieved as follows. That is, a storage medium, which records a program code of a software program that can implement the functions of the above-mentioned embodiments, is supplied to the system or apparatus. Then, a computer (or a CPU or MPU) of the system or apparatus reads out and executes the program code stored in the storage medium.

In this case, the program code itself read out from the storage medium implements the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be implemented by executing the readout program code by the computer. Also, functions of the above-mentioned embodiments may be implemented by some or all of actual processing operations executed by an OS running on the computer on the basis of an instruction of the program code.

Furthermore, the program code read out from the storage medium is written in a memory of a function extension board or a function extension unit, which is inserted in or connected to the computer. After that, the functions of the above-mentioned embodiments may be implemented by some or all of actual processing operations executed by a CPU or the like arranged in the function extension board or unit.

When the present invention is applied to the storage medium, that storage medium stores program codes corresponding to the aforementioned flowcharts (shown in FIGS. 2, 10, and 17).

As many apparently widely different embodiments of the present invention can be made without departing from the spirit and scope thereof, it is to be understood that the invention is not limited to the specific embodiments thereof except as defined in the claims.

CLAIM OF PRIORITY

This application claims priority from Japanese Patent Applications No. 2004-298888 filed on Oct. 13, 2004, No. 2004-361487 filed on Dec. 14, 2004 and No. 2005-270411 filed on Sep. 16, 2005, which are hereby incorporated by reference herein.

What is claimed is:

1. An information processing apparatus, which simulates a behavior of a sheet-like printing medium having a flexibility when the printing medium is conveyed in a conveying path including a convey roller pair, comprising:

setting means for setting a condition including an information associated with a rigidity of the convey roller pair that consist of a first roller and a second roller arranged in the conveying path;

contact area shape formation means for forming a shape along a surface shape of the first roller having a higher rigidity than the second roller as a shape of a contact area where the first roller and a second roller contact each other when a rigidity ratio of the first roller to the second roller based on the condition set by said setting means is not less than a predetermined value; and simulation means for simulating the behavior of the printing medium when the printing medium is conveyed in the conveying path on the basis of the shape of the contact area.

2. The apparatus according to claim 1, further comprising a display means, wherein said setting means displays a setting screen used to input a diameter of the first roller, a diameter of the second roller, and a center distance and rigidity ratio of the first roller and the second roller as setting conditions of the convey roller pair on the display means.

3. The apparatus according to claim 2, wherein said setting means displays a setting screen used to input a radius of curvature of the contact area as setting conditions of the convey roller pair on the display means, and said contact area shape formation means defines the input radius of curvature of the contact area as the shape of the contact area where the first roller and the second roller contact each other when an input the radius of curvature is selected.

4. The apparatus according to claim 3, wherein the radius of curvature of the contact area is set on the basis of a calculation of a deformation amount using a finite element method, and a contact area shape output based on the calculation result.

5. The apparatus according to claim 2, wherein when a rigidity of a first roller of the convey roller pair substantially equal to a rigidity of a second roller, said contact area shape formation means forms a straight line that connects intersections of circles that define the first roller and the second roller as the shape of the contact area.

6. The apparatus according to claim 1, wherein the information associated with the rigidity includes a rigidity ratio of the convey roller pair, and a plurality of rigidity ratios can be set.

7. The apparatus according to claim 6, further comprising means for selecting a radius of curvature of a contact area set in correspondence with the plurality of rigidity ratios.

8. The apparatus according to claim 1, further comprising:

drive condition setting means for setting a drive condition indicating a time-series drive velocity of the convey roller pair; and simulation timing adjustment means for, when a timing of a drive velocity change point in the drive condition does not match a simulation timing, matching the simulation timing with the timing of the drive velocity change point;

wherein said simulation means simulates at the matched simulation timing the behavior of the printing medium when the printing medium is conveyed in the conveying path on the basis of the condition set by said setting means and the drive condition.

9. An information processing apparatus, which simulates a behavior of a sheet-like printing medium having a flexibility when the printing medium is conveyed in a conveying path including a convey roller pair, comprising:

setting means for setting a condition including a position of the convey roller pair arranged in the conveying path;

drive condition setting means for setting a drive condition indicating a time-series drive velocity of the convey roller pair;

simulation timing adjustment means for, when a timing of a drive velocity change point in the drive condition does not match a simulation timing, matching the simulation timing with the timing of the drive velocity change point; and simulation means for simulating at the matched simulation timing, the behavior of the printing medium when the printing medium is conveyed in the conveying path on the basis of the condition set by said setting means and the drive condition.

10. The apparatus according to claim 9, wherein when the timing of the drive velocity change point in the drive condition does not match the simulation timing, said simulation timing adjustment means matches the simulation timing with the timing of the drive velocity change point by time-dividing a simulation timing step ($\Delta t$) used in numerical analysis.

11. The apparatus according to claim 10, wherein the timing of the drive velocity change point includes a drive start timing, a drive end timing, and a drive velocity change timing of the building parts.

12. A method of controlling an information processing apparatus, which simulates a behavior of a sheet-like printing medium having a flexibility when the printing medium is conveyed in a conveying path including a convey roller pair, comprising:

a setting step of setting a condition including an information associated with a rigidity of the convey roller pair that consist of a first roller and a second roller arranged in the conveying path;

a contact area shape formation step of forming a shape along a surface shape of the first roller having a higher rigidity than the second roller as a shape of a contact area where the first roller and a second roller contact each other when a rigidity ratio of the first roller to the second roller based on the condition set by said setting means is not less than a predetermined value; and a simulation step of simulating the behavior of the printing medium when the printing medium is conveyed in the conveying path on the basis of the shape of the contact area.

13. A method of controlling an information processing apparatus, which simulates a behavior of a sheet-like printing medium having a flexibility when the printing medium is conveyed in a conveying path including a convey roller pair, comprising:

a setting step of setting a condition including a position of the convey roller pair arranged in the conveying path;

a drive condition setting step of setting a drive condition indicating a time-series drive velocity of the convey roller pair;

a simulation timing adjustment step of matching, when a timing of a drive velocity change point in the drive condition does not match a simulation timing, the simulation timing with the timing of the drive velocity change point; and a simulation step of simulating at the matched simulation timing, the behavior of the printing medium when the printing medium is conveyed in the conveying path on the basis of the condition set by said setting means and the drive condition.

14. An information processing apparatus, which simulates a behavior of a sheet-like printing medium having a flexibility when the printing medium is conveyed in a conveying path, comprising:

definition means for defining a position of a convey roller pair to be arranged in the conveying path;

display means for displaying an input screen used to input parameters required to calculate a velocity variation rate of the convey roller pair caused by deformation of a convey roller with respect to the defined convey roller pair: and simulation means for calculating the velocity variation rate of the convey roller pair on the basis of the position of the convey rollers pair and the input parameters and simulating the behavior of the printing medium on the basis of the calculated velocity variation rate and the position of the convey roller pair.

15. The apparatus according to claim 14, wherein the parameter includes at least one of diameters of the convey roller pairs, a material and hardness of the convey roller, a thickness of a rubber layer of the convey roller, a thickness of a surface layer of the convey roller, and a pressure.

16. The apparatus according to claim 14, wherein said display means displays the conveying path defined in advance, and displays a convey roller pair with the calculated velocity variation rate in distinction from other convey roller pairs in the conveying path.

17. A method of controlling an information processing apparatus, which simulates a behavior of a sheet-like printing medium having a flexibility when the printing medium is conveyed in a conveying path, comprising:

a definition step of defining a position of a convey roller pair to be arranged in the conveying path;

a display step of displaying an input screen used to input parameters required to calculate a velocity variation rate of the convey roller pair caused by deformation of a convey roller with respect to the defined convey roller pair: and simulation means for calculating the velocity variation rate of the convey roller pair on the basis of the position of the convey rollers pair and the input parameters and simulating the behavior of the printing medium on the basis of the calculated velocity variation rate and the position of the convey roller pair.

18. A machine readable storage medium that stores a computer-executable program for implementing a control method of an information processing apparatus of claim 12.

19. A machine readable storage medium that stores a computer-executable program for implementing a control method of an information processing apparatus of claim 13.

20. A machine readable storage medium that stores a computer-readably storing a computer-executable program for implementing a control method of an information processing apparatus of claim 14.

* * * * *